US012017881B2

(12) United States Patent
Kuriyama et al.

(10) Patent No.: US 12,017,881 B2
(45) Date of Patent: Jun. 25, 2024

(54) POST-PROCESSING DEVICE, IMAGE FORMING APPARATUS, AND IMAGE FORMING SYSTEM

(71) Applicants: Atsushi Kuriyama, Kanagawa (JP); Yuuki Nakagawa, Kanagawa (JP); Takeshi Hirabayashi, Kanagawa (JP); Takato Mochizuki, Kanagawa (JP); Ryoh Suzuki, Kanagawa (JP); Kentaroh Fukami, Kanagawa (JP); Yusuke Tanaka, Kanagawa (JP); Takuya Fukuhara, Kanagawa (JP)

(72) Inventors: Atsushi Kuriyama, Kanagawa (JP); Yuuki Nakagawa, Kanagawa (JP); Takeshi Hirabayashi, Kanagawa (JP); Takato Mochizuki, Kanagawa (JP); Ryoh Suzuki, Kanagawa (JP); Kentaroh Fukami, Kanagawa (JP); Yusuke Tanaka, Kanagawa (JP); Takuya Fukuhara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 18/004,543

(22) PCT Filed: Aug. 18, 2021

(86) PCT No.: PCT/IB2021/057575

§ 371 (c)(1),
(2) Date: Jan. 6, 2023

(87) PCT Pub. No.: WO2022/043830

PCT Pub. Date: Mar. 3, 2022

(65) Prior Publication Data

US 2023/0242371 A1 Aug. 3, 2023

(30) Foreign Application Priority Data

Aug. 25, 2020 (JP) ..... 2020-141859

(51) Int. Cl.
*B65H 45/14* (2006.01)
*B65H 39/10* (2006.01)

(52) U.S. Cl.
CPC ..... *B65H 45/14* (2013.01); *B65H 39/10* (2013.01); *B65H 2301/42194* (2013.01); *B65H 2701/1311* (2013.01); *B65H 2801/27* (2013.01)

(58) Field of Classification Search
CPC .. B65H 2701/1311; B65H 2301/42194; B65H 2801/27; B65H 45/14; B65H 39/10
See application file for complete search history.

(56) References Cited

U.S. PATENT DOCUMENTS 10,745,236 B2 8/2020 Suzuki et al.
2009/0200725 A1 8/2009 Tamura et al.
(Continued)

FOREIGN PATENT DOCUMENTS

JP 2002-068572 3/2002
JP 2014-125312 7/2014

OTHER PUBLICATIONS

International Search Report issued on Nov. 26, 2021 in PCT/IB2021/057575 filed on Aug. 18, 2021.

*Primary Examiner* — Jennifer Bahls
(74) *Attorney, Agent, or Firm* — Harness, Dickey & Pierce, P.L.C.

(57) ABSTRACT

A post-processing device (200) includes a circulation conveyance path, a zeroth conveyer (R0), and a controller (50). The circulation conveyance path includes a first conveyance path (W1), a second conveyance path (W2), a third conveyance path (W3), a first conveyer (R1), a second conveyer (R2), and a third conveyer (R3). The first and second conveyers convey a preceding sheet (P1) along the first and second conveyance paths. The third conveyer conveys it from the third conveyance path to the first conveyance path. The zeroth conveyer conveys a following sheet (P2) toward
(Continued)

the first conveyer. The controller controls the third conveyer to stop the preceding sheet, subsequently controls the zeroth conveyer and the third conveyer to overlay the preceding sheet with the following sheet to form a sheet bundle (Q) having a shift amount (G) between a leading edges of the preceding sheet and the following sheet and strike the leading edges of the preceding sheet and the following sheet against the first conveyer.

10 Claims, 27 Drawing Sheets

(56) References Cited

U.S. PATENT DOCUMENTS

| | | | | |
|---|---|---|---|---|
| 2009/0206547 | A1 | 8/2009 | Tokita et al. | |
| 2009/0258774 | A1 | 10/2009 | Suzuki et al. | |
| 2009/0283961 | A1 | 11/2009 | Saito et al. | |
| 2010/0019435 | A1 | 1/2010 | Fukami | |
| 2010/0148417 | A1 | 6/2010 | Suzuki et al. | |
| 2010/0207314 | A1 | 8/2010 | Hattori et al. | |
| 2010/0237556 | A1 | 9/2010 | Azuma et al. | |
| 2011/0074081 | A1 | 3/2011 | Hirabayashi et al. | |
| 2012/0079797 | A1 | 4/2012 | Buri | |
| 2012/0217693 | A1 | 8/2012 | Fukami | |
| 2014/0054854 | A1* | 2/2014 | Kushida | B65H 29/22 271/306 |
| 2015/0037119 | A1 | 2/2015 | Tanaka et al. | |
| 2015/0307305 | A1* | 10/2015 | Saito | B42C 19/08 271/3.19 |
| 2015/0321871 | A1 | 11/2015 | Nakagawa et al. | |
| 2015/0336765 | A1 | 11/2015 | Sawada et al. | |
| 2017/0267483 | A1 | 9/2017 | Sawada et al. | |
| 2017/0341885 | A1 | 11/2017 | Suzuki et al. | |
| 2018/0370751 | A1 | 12/2018 | Sawada et al. | |
| 2019/0284009 | A1* | 9/2019 | Suzuki | B65H 29/145 |
| 2019/0284011 | A1* | 9/2019 | Furuhashi | B65H 9/002 |
| 2020/0071118 | A1 | 3/2020 | Sawada et al. | |
| 2020/0231401 | A1 | 7/2020 | Fukuhara et al. | |
| 2020/0239263 | A1 | 7/2020 | Hirako et al. | |

* cited by examiner

POST-PROCESSING DEVICE, IMAGE FORMING APPARATUS, AND IMAGE FORMING SYSTEM

CROSS-REFERENCE TO RELATED APPLICATIONS

This application is a national phase under 35 U.S.C. § 371 of PCT International Application No. PCT/IB2021/057575 which has an International filing date of Aug. 18, 2021, which claims priority to Japanese Application No. 2020-141859, filed Aug. 25, 2020, the entire contents of each of which are hereby incorporated by reference.

TECHNICAL FIELD

Embodiments of the present disclosure relate to a post-processing device, an image forming apparatus including the post-processing device, and an image forming system including the post-processing device.

BACKGROUND ART

Various types of post-processing devices are known to perform predetermined post-processing operations on a sheet-shaped recording medium on which an image is formed. The post-processing devices are included in an image forming apparatus as a part of the image forming apparatus or coupled to the image forming apparatus to form an image forming system.

When image formation processes to form an image on a sheet and the next processes (the post-processing) are performed as a series of operations, a long processing time of the post-processing requires a waiting time for next image formation processes, which may decrease productivity. To reduce the waiting time in the image forming apparatus due to the long processing time of the post-processing, the post-processing device including a pre-stack mechanism temporarily stores sheets conveyed after the image formation processes in the post-processing device.

CITATION LIST

Patent Literature

[PTL 1]
Japanese Unexamined Patent Application Publication No. 2014-125312

SUMMARY OF INVENTION

Technical Problem

Japanese Unexamined Patent Application Publication No. 2014-125312 discloses the post processing device including a sheet circulation path that enables producing the pre-stack mechanism without increasing the size of the post-processing device. In addition, Japanese Unexamined Patent Application Publication No. 2014-125312 also discloses a technique of causing a preceding sheet and a following sheet to abut against a conveyance roller disposed in the sheet circulation path and overlaying the sheets.

However the technique disclosed in Japanese Unexamined Patent Application Publication No. 2014-125312 can not correct a skew of the following sheet because the preceding sheet conveyed in the sheet circulation path abuts against the conveyance roller and bends, and the bending of the preceding sheet interfere with the conveyance of the following sheet.

An object of the present disclosure is to provide a post-processing device that improves accuracy of a skew correction of sheets overlaid when the post-processing device performs post processing including processes overlaying a plurality of sheets.

Solution to Problem

A post-processing device includes a circulation conveyance path, a zeroth conveyer, and a controller. The circulation conveyance path includes a first conveyance path, a second conveyance path, a third conveyance path, a first conveyer, a second conveyer, and a third conveyer. The first conveyer conveys a preceding sheet from the first conveyance path. The second conveyer conveys the preceding sheet along the second conveyance path. The third conveyer conveys the preceding sheet from the third conveyance path to the first conveyance path. The circulation conveyance path is configured to circulate the preceding sheet through the first conveyance path, the second conveyance path, and the third conveyance path in turn by the first conveyer, the second conveyer, and the third conveyer. The zeroth conveyer conveys a following sheet toward the first conveyer in the first conveyance path. The controller controls operations of the zeroth conveyer, the first conveyer, the second conveyer, and the third conveyer. The controller controls the third conveyer to stop the preceding sheet, subsequently controls the zeroth conveyer and the third conveyer to overlay the preceding sheet with the following sheet to form a sheet bundle having a shift amount between a leading edge of the preceding sheet and a leading edge of the following sheet and strike the leading edge of the preceding sheet and the leading edge of the following sheet against the first conveyer.

Advantageous Effects of Invention

According to the present disclosure, the post-processing device can improve accuracy of a skew correction of sheets overlaid when the post-processing device performs post processing including processes overlaying a plurality of sheets.

BRIEF DESCRIPTION OF DRAWINGS

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF EMBODIMENTS

Figure 1:
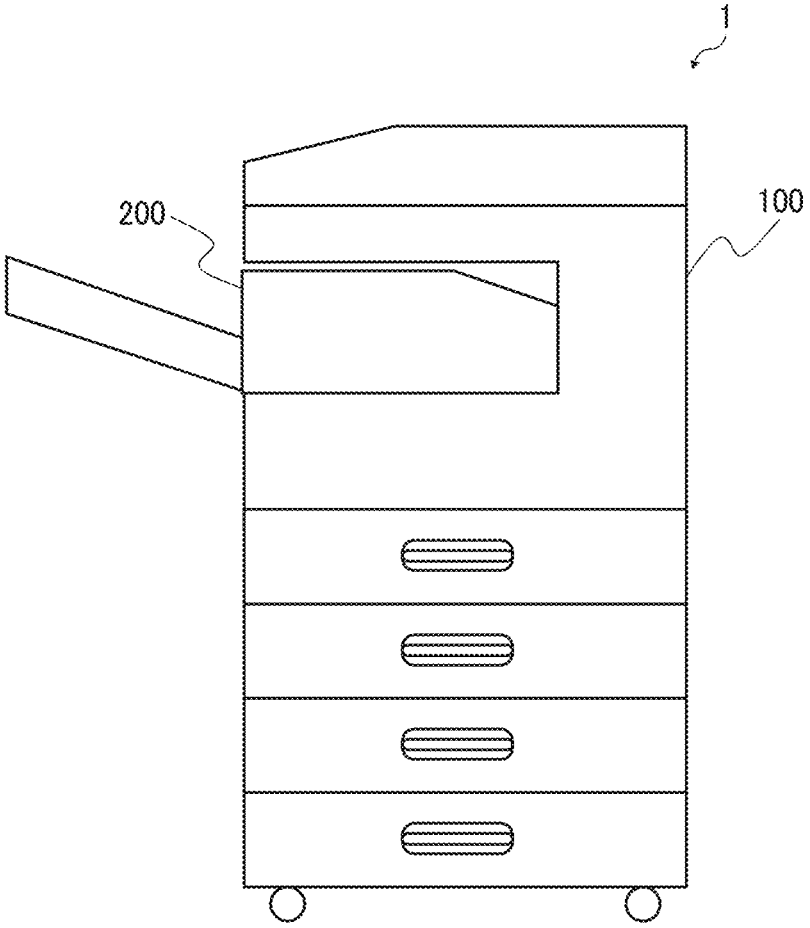
FIG. 1 is a side view of an image forming apparatus including a post-processing device according to an embodiment of the present disclosure.

The terminology used herein is for the purpose of describing particular embodiments only and is not intended to be limiting of the present invention. As used herein, the singular forms "a," "an," and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

[Outline of Image Forming Apparatus]

First, a description is given of an image forming apparatus according to an embodiment of the present disclosure. FIG. 1 is an external view of an image forming apparatus 1 that is appeared as a printer. The image forming apparatus 1 includes an image forming device 100 that is a printer body, and a sheet folding device 200 that functions as a post-processing device that is connectable to the image forming device 100. As illustrated in FIG. 1, the image forming apparatus 1 is an in-body ejection type apparatus, and the sheet folding device is incorporated in a part of the image forming device 100. That is, the image forming apparatus 1 includes the sheet folding device 200 as a post-processing device that receives a recording medium on which an image is formed and performs post-processing on the recording medium. The configuration of the sheet folding device 200 is described below.

[Functional Configuration of Control Block]

Figure 2:
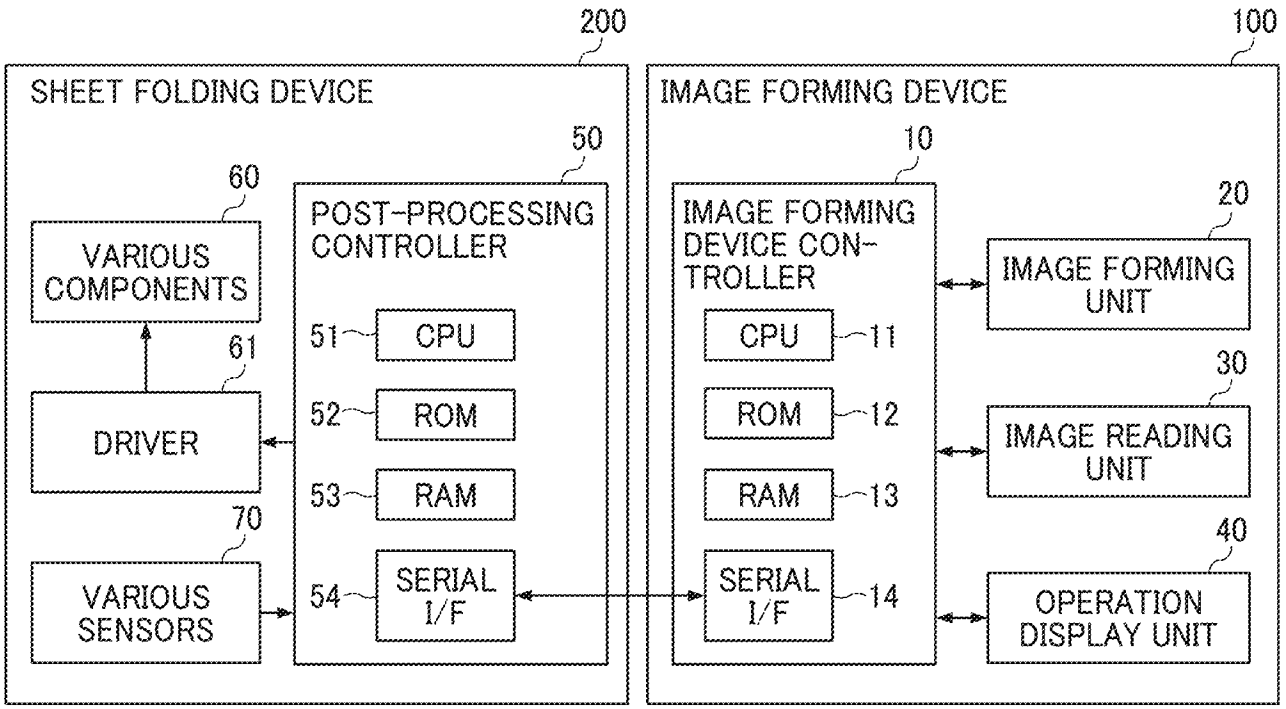
FIG. 2 is a block diagram illustrating a control configuration of the image forming apparatus of FIG. 1.

Next, with reference to FIG. 2, a description is given of control blocks regarding control operations of the image forming device 100 and the sheet folding device 200, according to the present embodiment. As illustrated in FIG. 2, the image forming device 100 includes an image forming device controller 10 as a control block. The image forming device controller includes a central processing unit (CPU) 11, a read only memory (ROM) 12, a random-access memory (RAM) 13, and a serial interface (serial I/F) 14.

The image forming device controller 10 is coupled to an image forming unit 20, an image reading unit 30, and an operation display unit 40 that is generally a control panel. Each of the image forming unit 20, the image reading unit 30, and the operation display unit 40 includes components to fully perform the functions. Each component of the image forming unit 20, the image reading unit 30, and the operation display unit 40 operates based on control signals issued by the image forming device controller 10.

The image forming unit 20 performs an image forming operation based on image data on a sheet P as a recording medium or a sheet-shaped recording medium. The image reading unit reads an image formed on the sheet P and acquires the image data of the image on the sheet P. The operation display unit 40 functions as an input unit via which operating conditions in the image forming unit 20 and the image reading unit 30 are input and as a display unit that displays, for example, the operation results.

The ROM 12 stores control programs for controlling the image forming unit 20, the image reading unit 30, and the operation display unit 40. The CPU 11 reads the control programs stored in the ROM 12 to the RAM 13. In addition, the CPU 11 stores data in the RAM 13 to use the data for the control and executes the control defined by the control programs while using the RAM 13 as a work area.

As illustrated in FIG. 2, the sheet folding device 200 includes a post-processing controller 50 as a control block. The post-processing controller 50 includes a central processing unit (CPU) 51, a read only memory (ROM) 52, a random-access memory (RAM) 53, and a serial interface (serial I/F) 54.

The post-processing controller 50 is coupled to various components 60 and various sensors 70. The various components 60 are, for example, sheet conveying rollers and pairs of sheet folding rollers, and include configurations to perform sheet folding operations on a recording medium or recording media. The various components 60 are, for example, sheet conveying rollers and pairs of sheet folding rollers, and include configurations to perform sheet folding operations on a recording medium or recording media. A drive motor drives the various components 60. For example, the drive motor drives and rotates various rollers and various roller pairs. The post-processing controller 50 controls a driver 61 coupled to the post-processing controller 50 to drive the drive motor driving the various components 60. The various components 60 performs operations such as conveyance of the sheet P as the recording medium and folding processing to fold the sheet P.

The various sensors 70 are a plurality of sheet detecting sensors to detect the sheet P at positions in a sheet conveyance path and disposed at the positions in the sheet conveyance path described below. The post-processing controller 50 performs control programs stored in advance and, based on detection signals output from the various sensors 70 to the post-processing controller 50, determines conveyance amounts and positions of the sheet P that the post-processing is performed. Based on driving amounts of the various components 60, the post-processing controller 50 can calculate the conveyance amounts (conveyance distances) of the sheet P after the sheet detecting sensors detect a leading edge of the sheet P and determine the positions of the sheet P.

The ROM 52 stores the control program for the post-processing controller 50 to perform predetermined processing. The CPU 51 reads the control programs stored in the ROM 52 to the RAM 53. In addition, the CPU 51 stores data in the RAM 53 to use the data for the control for sheet folding processing and executes the control for the sheet folding processing defined by the control programs while using the RAM 53 as a work area. As described above, the post-processing controller 50 performs the control program stored in the ROM 52, controls the sheet detecting sensors to detect the sheet P, and controls various components 60 to convey the sheet P.

The image forming device controller 10 included in the image forming device 100 and the post-processing controller 50 included in the sheet folding device 200 are communicably coupled to each other via the serial I/F 14 and the serial I/F 54. This communication path is used to exchange control commands and data to be used for conveyance control of the recording medium, between the image forming device controller 10 and the post-processing controller 50. The sheet folding device 200 determines whether the conveyance control and the sheet folding operations are performed on a recording medium and switches the types of the sheet folding operation, based on the control commands and data related to the recording medium sent from the image forming device 100, and data related to the positions of the recording medium obtained from the various sensors 70.

The image forming device 100 (that is, the image forming device controller 10) sends the sheet folding device 200 (that is, the post-processing controller 50) information related to the sheet P as data. The data include a type and a thickness of the sheet P sent from the image forming device 100 and received by the sheet folding device 200. Additionally, the data also includes the number of sheets P overlaid, the type of folding processes performed on the sheet P, and whether an image exists at the folding position in the sheet P. The control commands notified from the image forming device controller 10 to the post-processing controller 50 include a command notifying whether or not the delivered sheet P corresponds to the last page (that is, a final sheet) of the unit processed collectively.

[Outline of Post-Processing Device]

Figure 3:
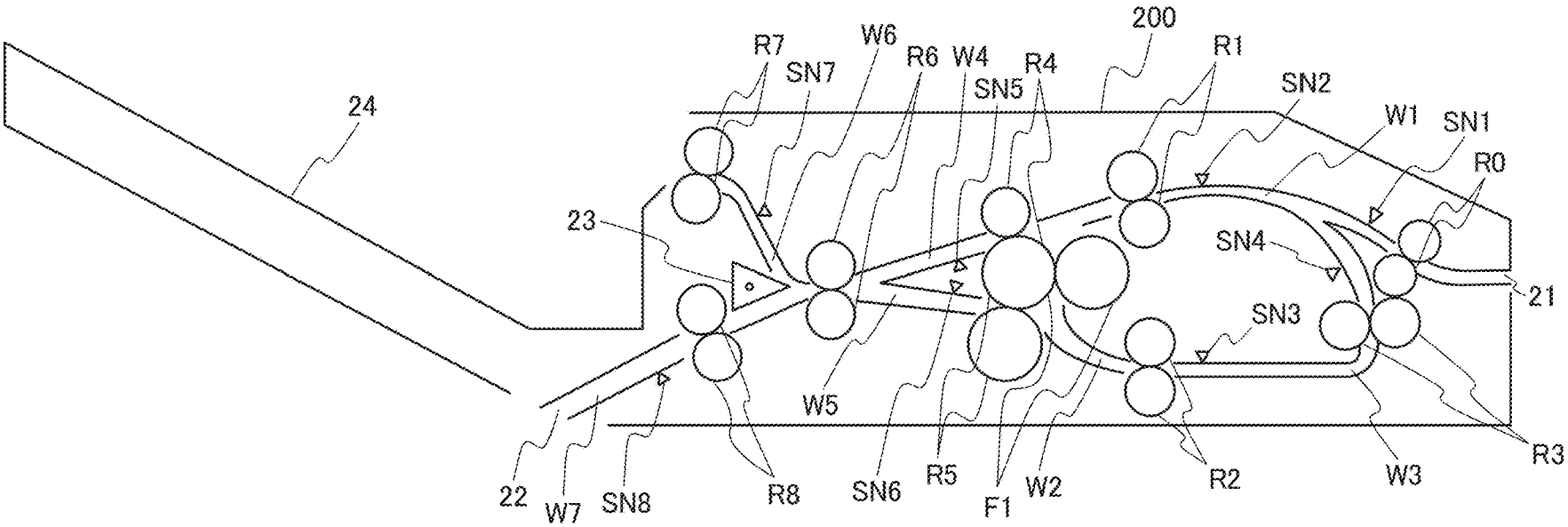
FIG. 3 is a diagram illustrating an inner configuration of a sheet folding device functioning as the post-processing device according to the present disclosure.

The following describes an internal configuration of the sheet folding device 200 as the post-processing device according to the embodiment of the present disclosure. FIG. 3 is a diagram illustrating a schematic configuration inside the sheet folding device 200. The sheet folding device 200 includes a plurality of sheet conveyance paths, a plurality of roller pairs, and a plurality of sheet detecting sensors. Each of the plurality of roller pairs functions as a conveyer or a folder.

The sheet folding device 200 includes seven conveyance paths roughly distinguished from each other. As illustrated in FIG. 3, the sheet folding device 200 includes a first conveyance path W1, a second conveyance path W2, a third conveyance path W3, a fourth conveyance path W4, a fifth conveyance path W5, a sixth conveyance path W6, and a seventh conveyance path W7.

In addition, the sheet folding device 200 includes a plurality of roller pairs disposed along each of the first conveyance path W1, the second conveyance path W2, the third conveyance path W3, the fourth conveyance path W4, the fifth conveyance path W5, and the sixth conveyance path W6. Each of the plurality of roller pairs is disposed in each of the conveyance paths to convey the sheet P and functions as a zeroth conveyer R0, a first conveyer R1, a second conveyer R2, a third conveyer R3, a fourth conveyer R4, a fifth conveyer R5, and a sixth conveyer R6. The post-processing controller 50 performs the control programs to control these conveyers and start and stop the conveyance of the sheet P.

The sheet folding device 200 includes a plurality of switching guides. For example, the plurality of switching guides guides the sheet P from the first conveyance path W1 to the second conveyance path W2, and the sheet P guided and conveyed to the second conveyance path W2 is conveyed to the first conveyance path W1 through the third conveyance path W3. That is, the plurality of switching guides guides the sheet P to a circulation conveyance path in which the sheet P is circulated. Or, the plurality of switching guides guides the sheet P to the fourth conveyance path W4 downstream from the first conveyance path W1, that is, does not guide the sheet P from the first conveyance path W1 to the circulation conveyance path downstream from the second conveyance path W2. Or, the plurality of switching guides guides the sheet P from the first conveyance path W1 to the second conveyance path W2 and further guides the sheet P to the fifth conveyance path W5 downstream from the second conveyance path W2. To perform the above-described switching of the conveyance paths, the sheet folding device 200 includes the plurality of switching guides.

As illustrated in FIGS. 4 to 10, the plurality of switching guides include a first switching guide J1, a second switching guide J2, and a third switching guide J3. The plurality of switching guides are included in various components 60 controlled by the post-processing controller 50. The post-processing controller 50 controls operations of the plurality of switching guides to determine the conveyance paths of the sheet P. Additionally, the sheet folding device 200 includes a first folder F1 and a second folder F2 in the circulation conveyance path to fold the sheet P.

The sheet folding device 200 includes the zeroth conveyer R0 serving as an entry roller pair in the vicinity of an entrance 21 that receives the sheet P from the image forming device 100. The post-processing controller 50 controls a drive motor that rotates the zeroth conveyer R0 to start rotation of the zeroth conveyer R0 after the post-processing controller 50 receives a signal informing that the sheet P will be ejected from the image forming device 100. Subsequently, the leading edge of the sheet P reaches the nip of the roller pair of the zeroth conveyer R0, and the zeroth conveyer R0 conveys the sheet P to the conveyance path downstream from the zeroth conveyer R0.

As described below, before the sheet folding device 200 ejects the sheet P received from the image forming device 100 to an outlet 22 downstream from all conveyance paths, the sheet folding device 200 receives the next sheet P and performs a sheet overlay process in which the next sheet P is conveyed and overlaid on the previous sheet P and the folding process. In the following description, the sheet P received from the image forming device 100 in the above description, that is, a preceding sheet is referred to as "the preceding sheet P1" for the sake of description. The next sheet P in the above description, that is, the sheet P following the preceding sheet P1 is referred to as "the following sheet P2". The following sheet P2 is received by the sheet folding device 200 after the preceding sheet P1 is received by the sheet folding device 200. In addition, a sheet P that is received by the sheet folding device 200 next to the following sheet P2 and be subjected to the sheet overlay process is referred to as a "next sheet P3". In addition, a plurality of sheets P stacked on each other is referred to as a "sheet bundle Q".

Note that the sheet folding device 200 may overlay and fold three or more sheets P. The number of sheets P to be stacked or folded in the sheet folding device 200 is not limited to three.

The first conveyer R1 includes a pair of rollers facing each other across the first conveying path W1, and a nip is formed between the rollers. The first folder F1 includes a pair of rollers facing each other and being disposed between the first sheet conveyance path W1 and the second sheet conveyance path W2, and a nip is formed between the rollers. The path guided by the nip in the first conveyer R1 and the nip in the first folder F1 guides the preceding sheet P1 from the first conveyance path W1 to the second conveyance path W2.

The preceding sheet P1 guided to the second conveyance path W2 is conveyed to the third conveyance path W3 by the second conveyer R2. Subsequently, the third conveyer R3 temporarily stops the conveyance of the preceding sheet P1 in the third conveyance path W3. The third conveyer R3 starts the conveyance of the preceding sheet P1 that is temporarily stopped in the third conveyance path W3 when the sheet folding device 200 receives the following sheet P2 from the image forming device 100. As a result, the preceding sheet P1 returns to a portion upstream from the first conveyer R1 in the first conveyance path W1 and meets the following sheet P2. As described above, the circulation conveyance path is configured.

In the circulation conveyance path described above, the preceding sheet P1 and the following sheet P2 are overlaid to form a sheet bundle Q. The following describes the folding processes performed on the sheet bundle Q.

The post-processing controller 50 controls the first folder F1 to perform the folding processes for the sheet bundle Q. The sheet bundle Q subjected to the folding processes by the first folder F1 is delivered from the second conveyance path W2 to the fifth conveyance path W5. The fourth conveyer R4, the fifth conveyer R5, and the first folder F1 are driven by the same drive motor. The drive motor is rotatable in both directions, which are the forward direction and the reverse direction. By changing the direction of rotation, the drive motor conveys the sheet bundle Q in which the preceding sheet P1 and the following sheet P2 are overlaid and performs a sheet folding processes.

A bifurcating claw 23 is disposed downstream from the sixth conveyer R6 and adjacent to the sixth conveyer R6. The bifurcating claw 23 switches guide postures to guide the sheet P (or the sheet bundle Q) to the sixth conveyance path W6 or the seventh conveyance path W7. The bifurcating claw 23 may be driven by, for example, a solenoid to switch the guide postures. Instead of the solenoid, a drive mechanism including a motor, a gear, a cam, and the like may be used.

The sheet P having passed through the fourth conveyance path W4 or the fifth conveyance path W5 is ejected and stacked on an output tray 24 of the sheet folding device 200. The seventh conveyance path W7 is a path for delivering the sheet P to a post-processing device when an image forming system is configured to include the post-processing device disposed downstream from the sheet folding device 200. The post-processing device performs post-processing such as alignment processing or binding processing on the folded sheet P or the non-folded sheet P.

A first sheet detecting sensor SN1 is disposed downstream from the zeroth conveyer R0 and adjacent to the zeroth conveyer R0 on the first conveyance path W1. A second sheet detecting sensor SN2 is disposed upstream from the first conveyer R1 and adjacent to the first conveyer R1. A third sheet detecting sensor SN3 is disposed downstream from the second conveyer R2 and adjacent to the second conveyer R2 on the third conveyance path W3. A fourth sheet detecting sensor SN4 is disposed downstream from the third conveyer R3 and adjacent to the third conveyer R3 on the third conveyance path W3. A fifth sheet detecting sensor SN5 is disposed downstream from the fourth conveyer R4 and adjacent to the fourth conveyer R4 on the fourth conveyance path W4. A sixth sheet detecting sensor SN6 is disposed downstream from the fifth conveyer R5 and adjacent to the fifth conveyer R5 on the fifth conveyance path W5. A seventh sheet detecting sensor SN7 is disposed downstream from the sixth conveyer R6 and adjacent to the sixth conveyer R6 on the sixth conveyance path W6.

The sheet folding device 200 illustrated in FIG. 3 can perform a letter fold-in and a letter fold-out on the overlaid sheets P. With reference to FIGS. 4 to 10, the following describes operations in which the two sheets P are overlaid to form the sheet bundle Q in the sheet circulation path.

Figure 4:
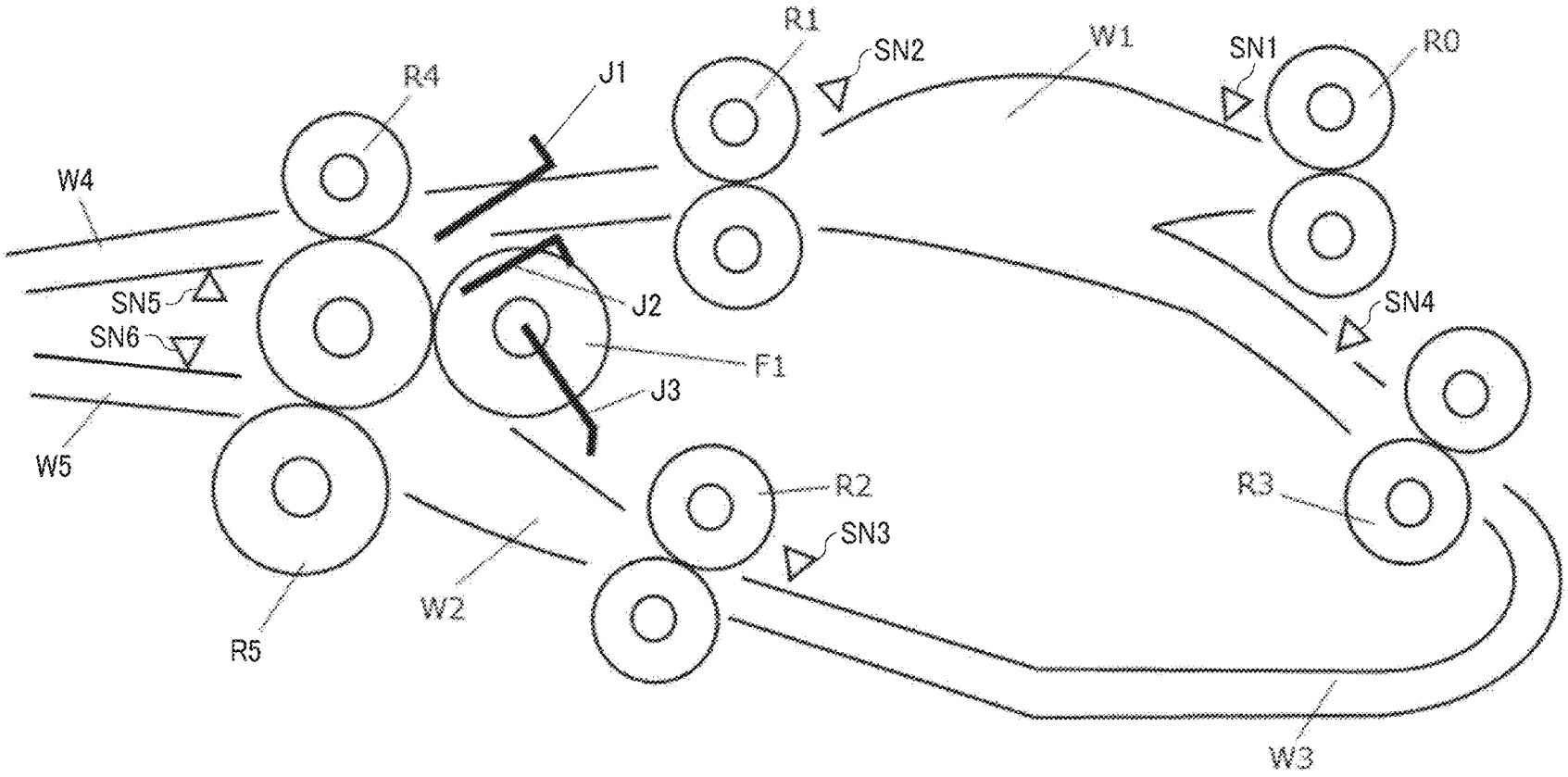
FIG. 4 is an enlarged view of the inner configuration of the sheet folding device according to the embodiment of the present disclosure.
Figure 5:
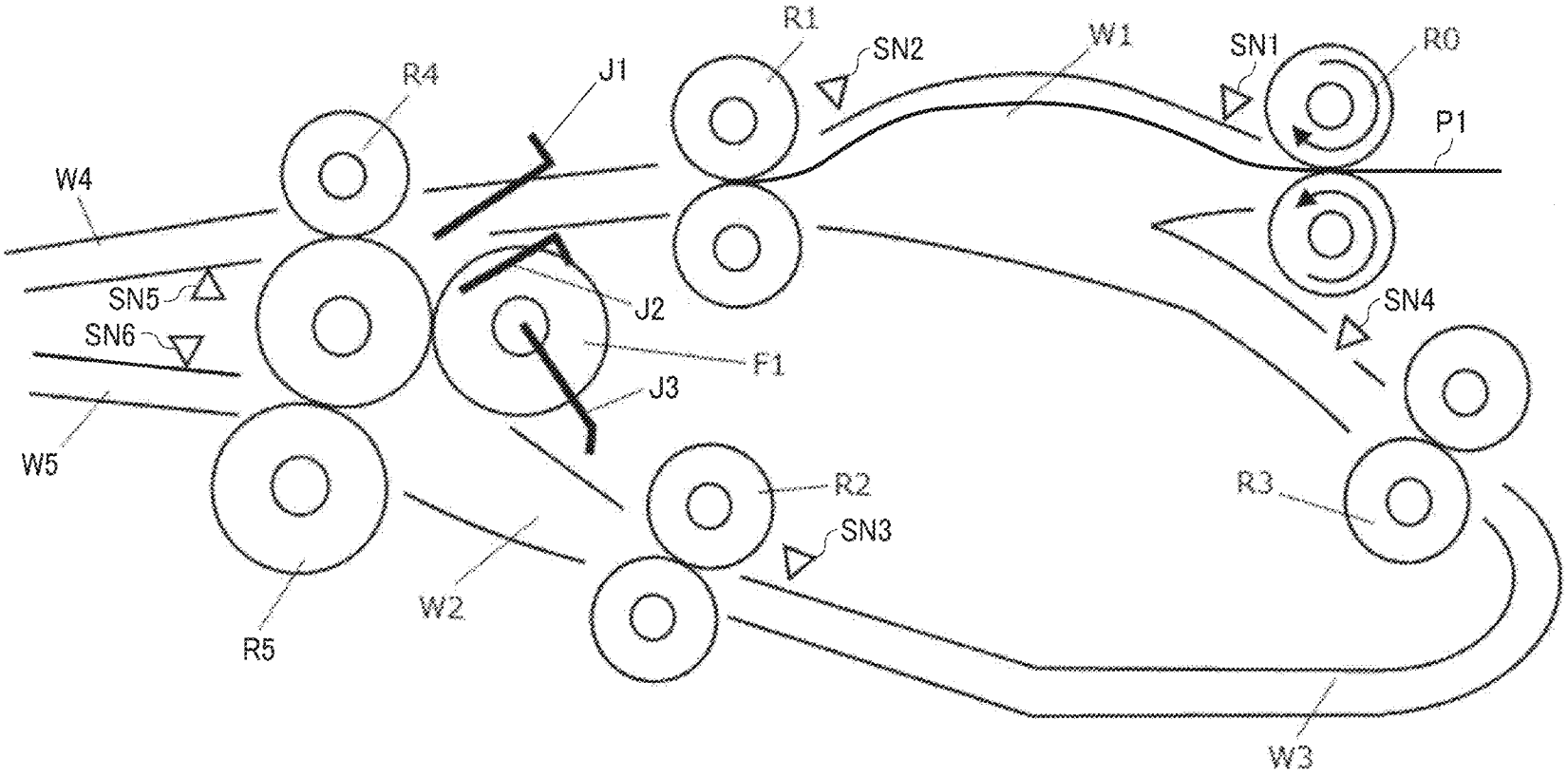
FIG. 5 is an enlarged view of the inner configuration of the sheet folding device according to the embodiment of the present disclosure, illustrating a post-processing process.

FIG. 4 illustrates the sheet folding device 200 in an initial state before the sheet P is conveyed from the image forming device 100. The post-processing controller 50 in the sheet folding device 200 starts rotating the zeroth conveyer R0 when the leading edge of the preceding sheet P1 conveyed from the image forming device 100 reaches to the outlet of the image forming device 100. The zeroth conveyer R0 receives the preceding sheet P1 and conveys the preceding sheet P1 to the first conveyance path W1 as illustrated in FIG. 5. In addition, the post-processing controller 50 moves the first switching guide J1 as illustrated in FIG. 4 to convey the preceding sheet P1 not to the fourth conveyance path W4 but to the second conveyance path W2.

The first sheet detecting sensor SN1 detects the leading edge of the preceding sheet P1 conveyed by the zeroth conveyer R0 and notifies a detection signal to the post-processing controller 50. When the first sheet detecting sensor detects the leading edge of the preceding sheet P1, the first conveyer is stopped. As illustrated in FIG. 5, the post-processing controller 50 maintains the first conveyer R1 stopped until a conveyance amount of the preceding sheet P1 required to form the bending of the preceding sheet P1 to correct the skew of the leading edge of the preceding sheet P1 (that is, a first protrusion amount) reaches a predetermined value after the detection signal is notified.

Figure 6:
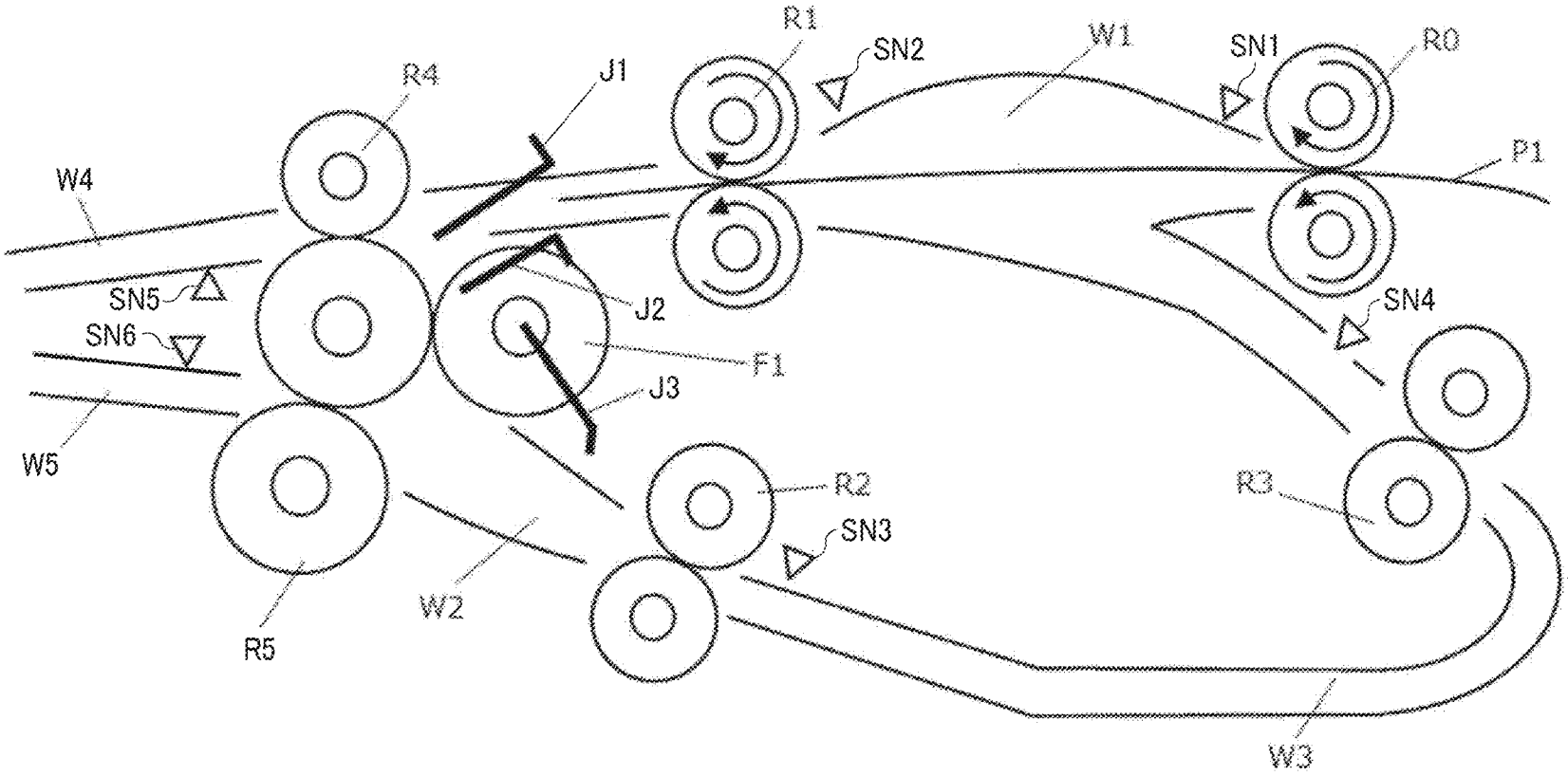
FIG. 6 is an enlarged view of the inner configuration of the sheet folding device according to the embodiment of the present disclosure, illustrating a process next to the process in FIG. 5.

As illustrated in FIG. 6, at a timing at which the first protrusion amount reaches the predetermined value, that is, the timing at which correcting the skew of the leading edge of the preceding sheet P1 is completed, the post-processing controller 50 starts rotation of the first conveyer R1.

When the leading edge of the preceding sheet P1 enters the nip of the first conveyer R1, the post-processing controller 50 rotates the first folder F1, the second conveyer R2, and the third conveyer R3.

Figure 7:
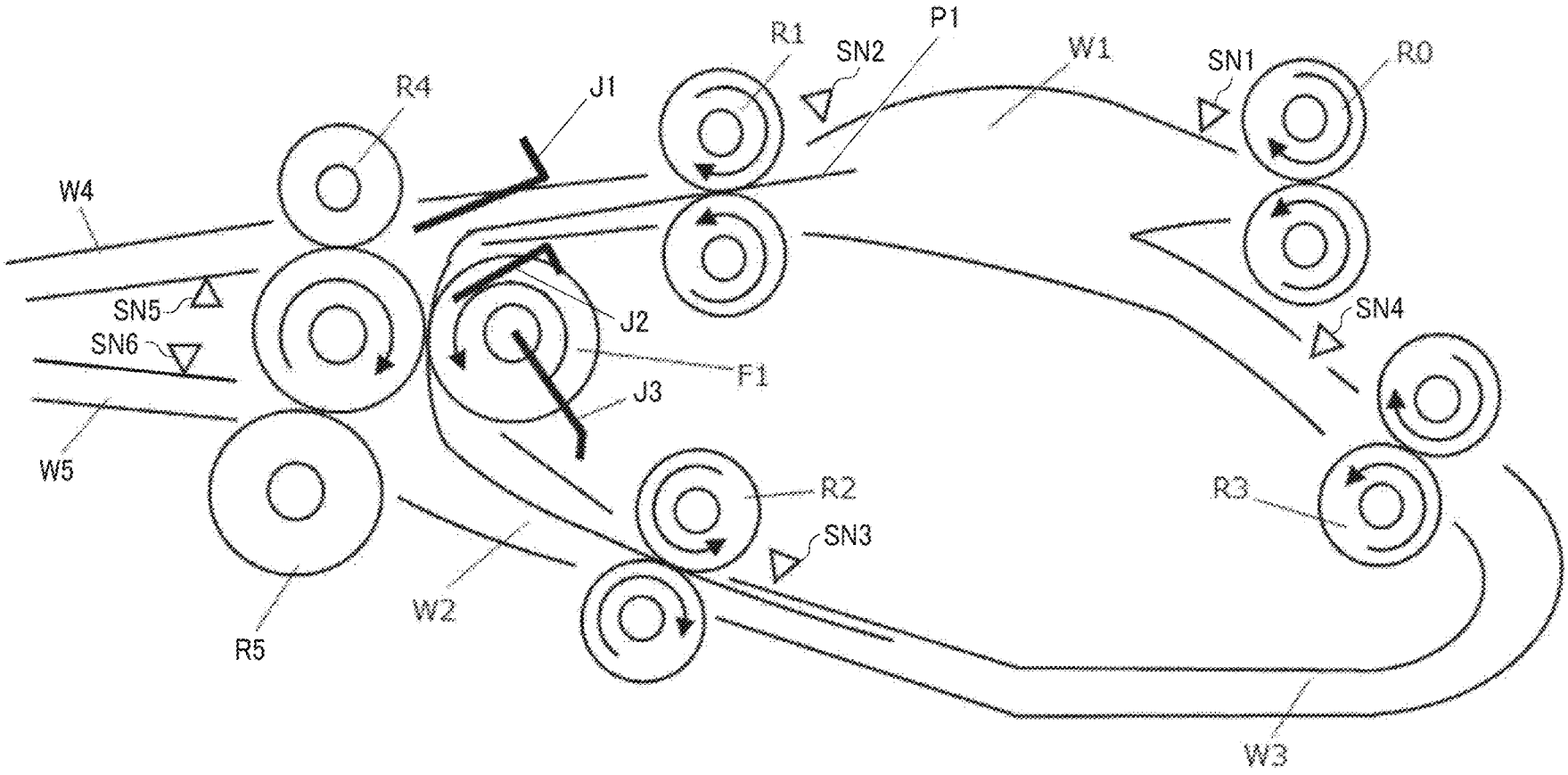
FIG. 7 is an enlarged view of the inner configuration of the sheet folding device according to the embodiment of the present disclosure, illustrating a process next to the process in FIG. 6.
Figure 8:
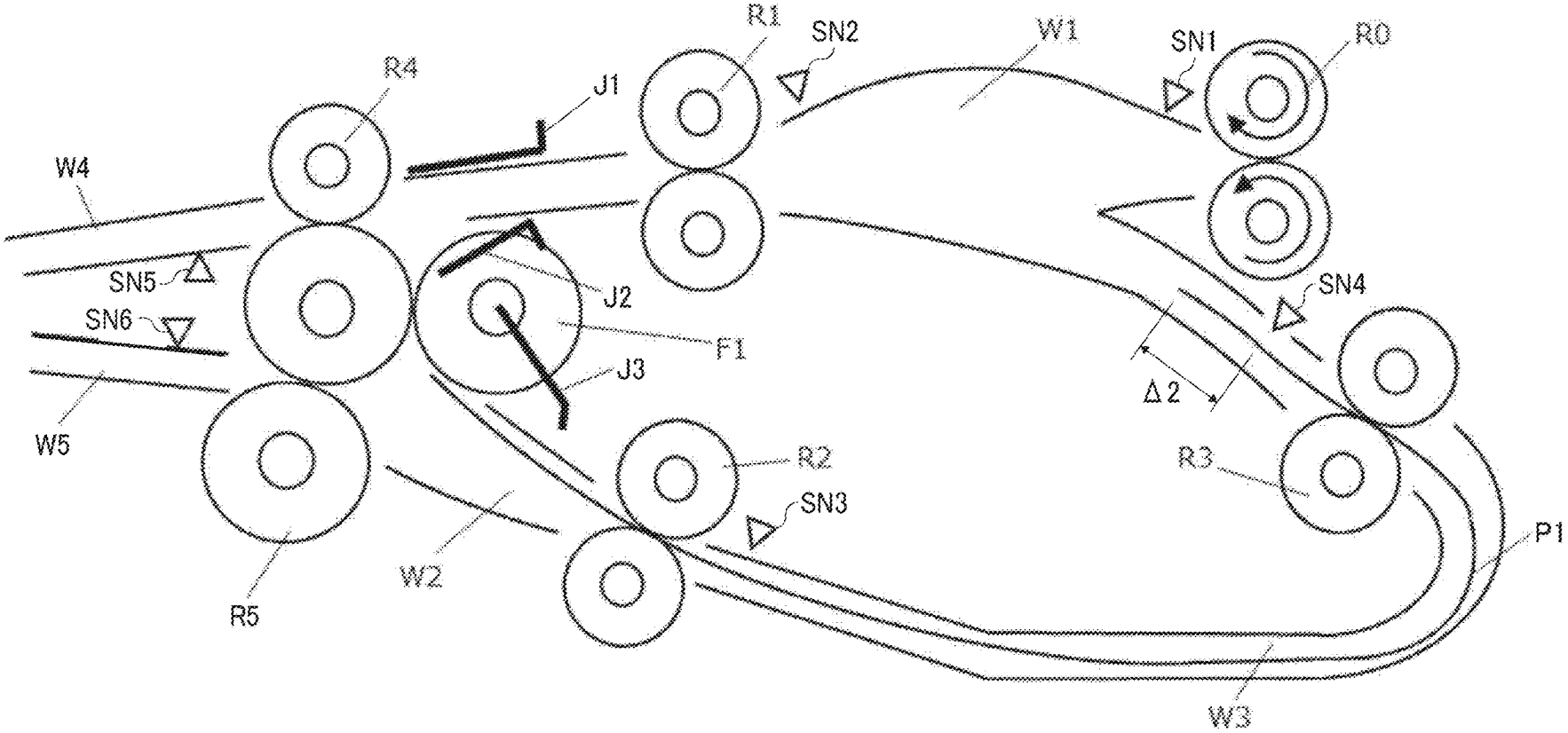
FIG. 8 is an enlarged view of the inner configuration of the sheet folding device according to the embodiment of the present disclosure, illustrating a process next to the process in FIG. 7.

As illustrated in FIG. 7, rotations of the first conveyer R1 and the first folder F1 convey the preceding sheet P1 to the second conveyance path W2, and the preceding sheet P1 is conveyed along the downward slope of the second conveyance path W2. The second conveyer R2 convey the preceding sheet P1 conveyed along the downward slope of the second conveyance path W2 to the third conveyance path W3. Subsequently, the third conveyer R3 conveys the preceding sheet P1 to the fourth sheet detecting sensor SN4. The fourth sheet detecting sensor SN4 detects the leading edge of the preceding sheet P1 and notifies a detection signal to the post-processing controller 50. After the post-processing controller 50 receives the detection signal from the fourth sheet detecting sensor SN4, the post-processing controller 50 calculates the timing at which the leading edge of the preceding sheet P1 reaches the position corresponding to the second protrusion amount 42 from the position of the fourth sheet detecting sensor SN4.

When the post-processing controller 50 determines that the leading edge of the preceding sheet P1 reaches the position corresponding to the second protrusion amount 42, the post-processing controller 50 stops the rotation of the first folder F1, the second conveyer R2, and the third conveyer R3 to stop the conveyance of the preceding sheet P1 as illustrated in FIG.

However, the post-processing controller 50 continues the rotation of the first conveyer R1 to receive the following sheet P2 conveyed next from the image forming device 100 even when the post-processing controller 50 stops the conveyance of the preceding sheet P1.

Figure 9:
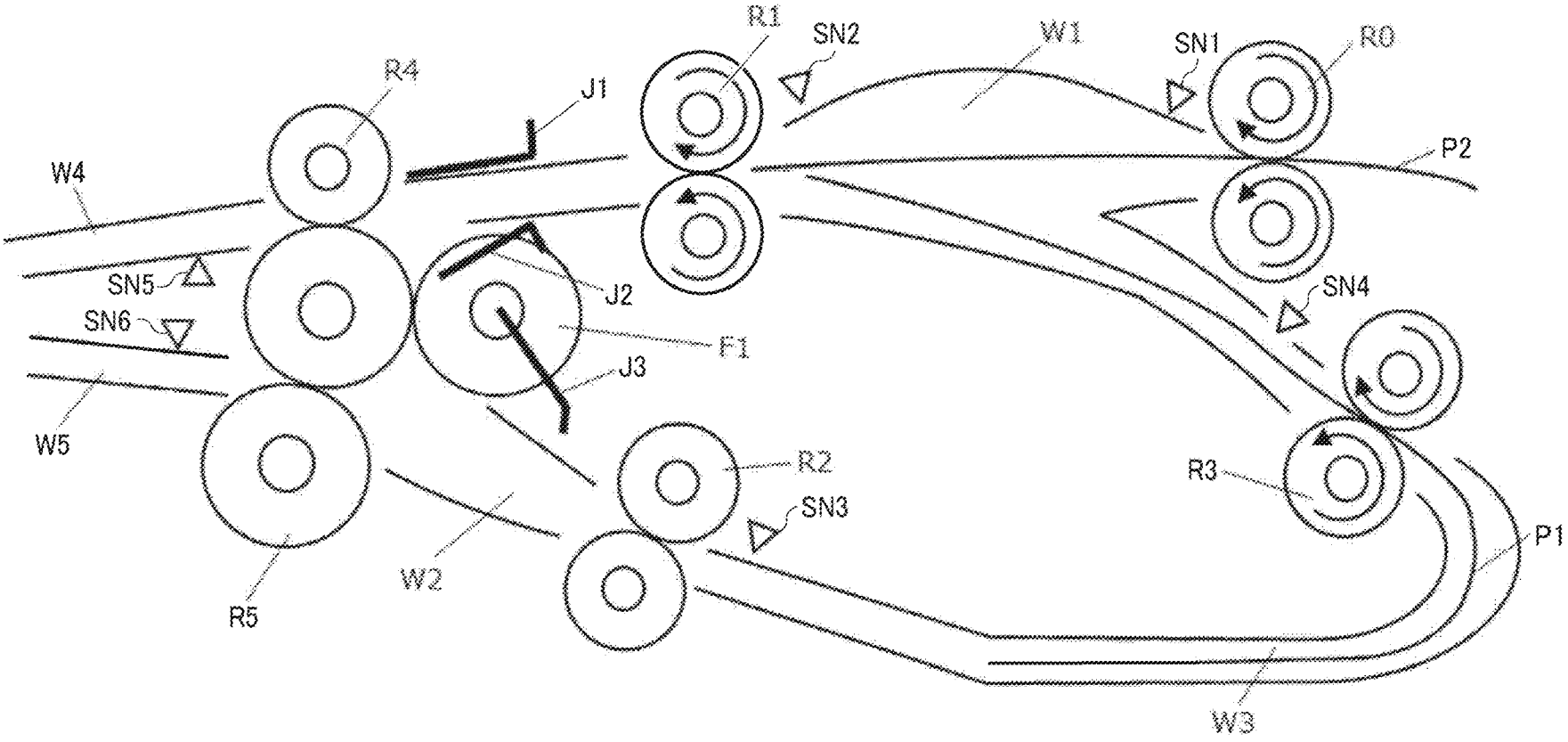
FIG. 9 is an enlarged view of the inner configuration of the sheet folding device according to the embodiment of the present disclosure, illustrating a process next to the process in FIG. 8.

Subsequently, the post-processing controller 50 calculates a stop timing of the conveyance of the following sheet P2 conveyed as illustrated in FIG. 9 after the first sheet detecting sensor SN1 detects the leading edge of the following sheet P2 and notifies a detection signal to the post-processing controller 50. At the stop timing, the leading edge of the following sheet P2 reaches a position away from the first sheet detecting sensor SN1 by a third protrusion amount Δ3. When the leading edge of the following sheet P2 reaches the position corresponding to the third protrusion amount Δ3, the post-processing controller 50 resumes the rotation of the second conveyer R2 and the third conveyer R3. As a result, as illustrated in FIG. 9, the conveyance of the preceding sheet P1, which has been stopped, is resumed. Thus, the leading edge of the following sheet P2 comes into contact with the first conveyer R1 slightly before the leading edge of the preceding sheet P1 comes into contact with the first conveyer R1, and the skew of the following sheet P2 is corrected.

The post-processing controller 50 calculates the third protrusion amount Δ3 based on a speed of the sheet moved by the zeroth conveyer R0, a speed of the sheet conveyed by the third conveyer R3, positions of the zeroth conveyer R0, the third conveyer R3, the first sheet detecting sensor SN1, the second sheet detecting sensor SN2, and the fourth sheet detecting sensor SN4, that is, distances between these members. The third protrusion amount Δ3 defines a shift amount between the leading edges of the preceding sheet P1 and the following sheet P2 when the leading edges of the preceding sheet P1 and the following sheet P2 meet each other before the preceding sheet P1 and the following sheet P2 come in contact with the first conveyer R1.

Figure 10:
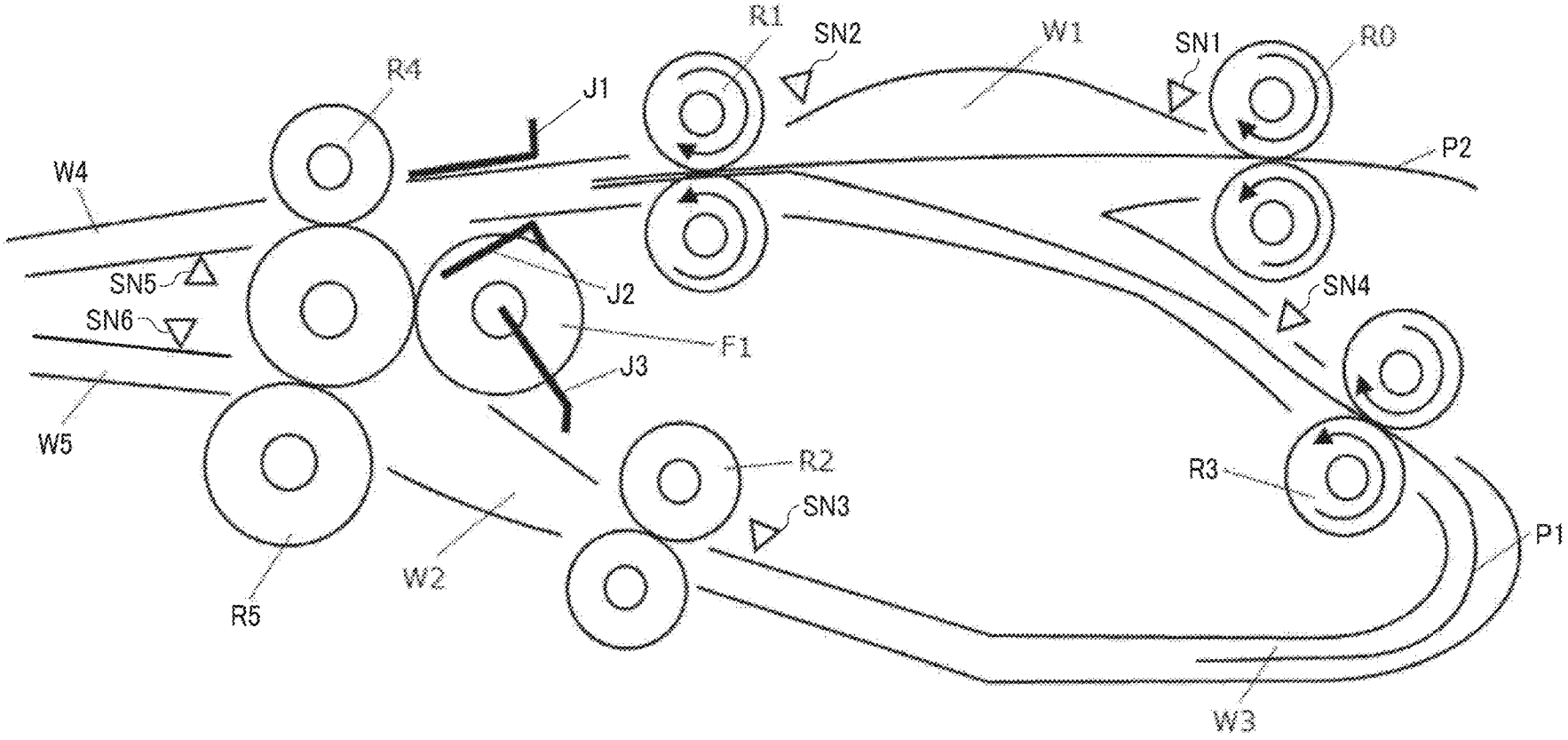
FIG. 10 is an enlarged view of the inner configuration of the sheet folding device according to the embodiment of the present disclosure, illustrating a process next to the process in FIG. 9.

Thereafter, as illustrated in FIG. 10, the leading edge of the preceding sheet P1 and the leading edge of the following sheet P2 meet each other before the second sheet detecting sensor SN2 to form the sheet bundle Q, and the sheet bundle Q passes through the nip of the first conveyer R1 and is conveyed downstream from the nip of the first conveyer R1.

Thereafter, the post-processing controller 50 determines whether a number of sheets to be folded notified by the image forming device 100 coincides a number of sheets received by the sheet folding device 200. When the number of sheets to be folded coincides the number of sheets received by the sheet folding device 200, the post-processing controller 50 performs folding processing described below. When the number of sheets to be folded does not coincide the number of sheets received by the sheet folding device 200, the post-processing controller 50 performs the processes as illustrated in FIGS. 7 to 9 again so that the next sheet P3 conveyed from the image forming device 100 (that is the sheet P conveyed after the following sheet P2 is conveyed) meets the sheet bundle Q to overlay the next sheet P3 on the sheet bundle Q. Note that the post-processing controller 50 can determine whether the sheet P is conveyed to a position immediately before the nip of the second conveyer R2 based on, for example, the number of drive steps of a drive motor that drives and rotates the first conveyer R1. Accordingly, a stepping motor is preferably used as the drive motor to drive and rotate each conveyer.

[Outline of Folding Processing]

The following describes folding operations in the sheet folding device 200 according to the present embodiment. FIGS. 11 to 14 are enlarged views of the inner configuration of the sheet folding device to illustrate letter fold-out operations performed on the sheet bundle Q formed in a portion upstream the first conveyer R1.

As described with reference to FIG. 10, the preceding sheet P1 meets the following sheet P2 to form the sheet bundle Q, and the zeroth conveyer R0 and the first conveyer R1 convey the sheet bundle Q. When the leading edge of the sheet bundle Q enters the nip of the first conveyer R1, the sheet bundle Q is conveyed to the fourth conveyer R4.

Figure 11:
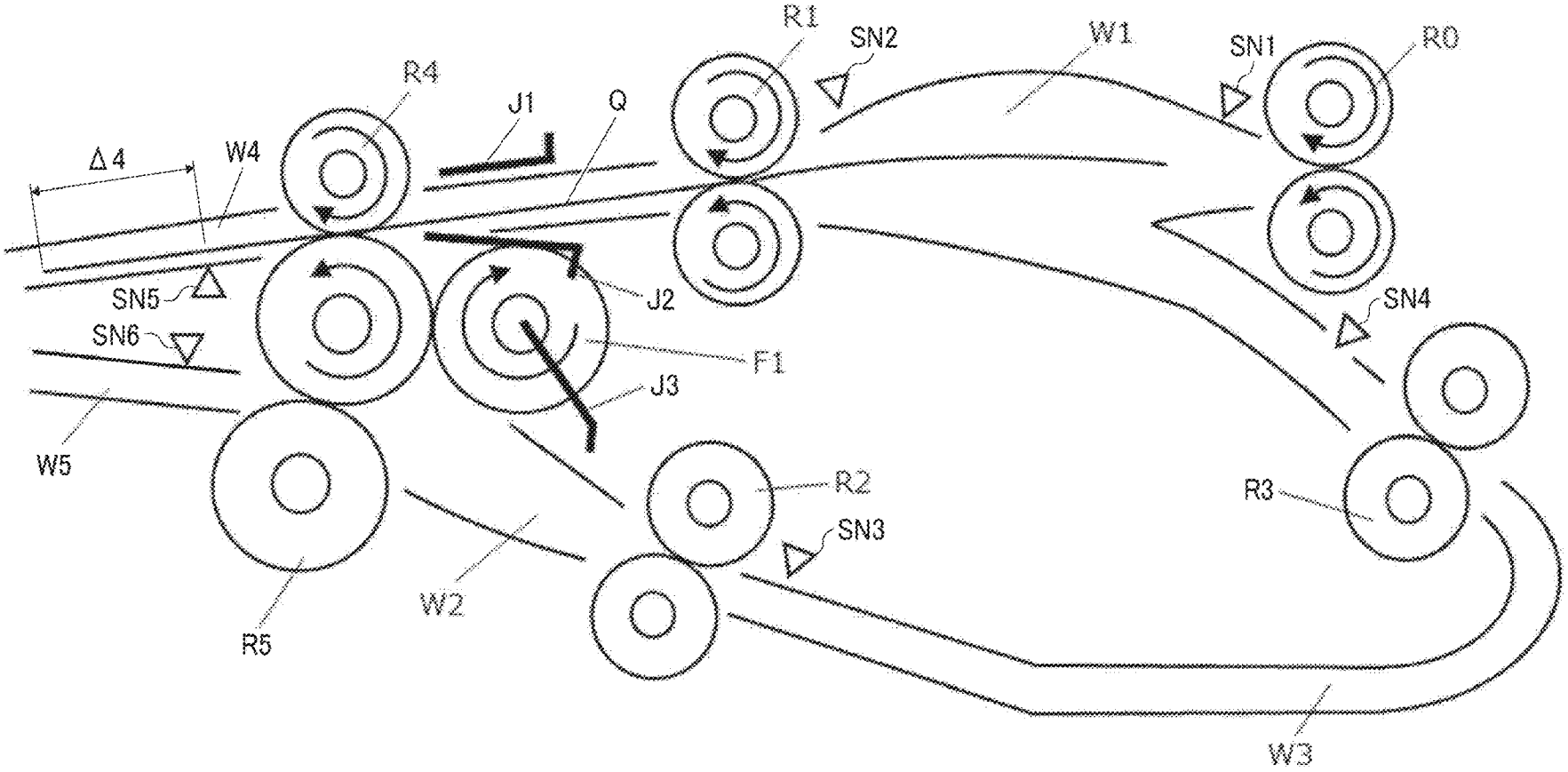
FIG. 11 is an enlarged view of the inner configuration of the sheet folding device according to the embodiment of the present disclosure, illustrating a folding operation next to the process in FIG. 10.

When the first conveyer R1 conveys the sheet bundle Q immediately before the nip of the fourth conveyer R4, the post-processing controller 50 drives a motor to rotate the fourth conveyer R4 in the direction indicated by the arc arrows in FIG. 11 in addition to the first conveyer R1 rotated in the direction of the arc arrows in FIG. 11. After the fifth sheet detecting sensor SN5 detects the leading edge of the sheet bundle Q and notifies the detection signal to the post-processing controller 50, the post-processing controller 50 drives the fourth conveyer R4 to convey the leading edge of the sheet bundle Q by a fourth protrusion amount 44. When the leading edge of the sheet bundle Q is conveyed by the fourth protrusion amount 44, the post-processing controller 50 temporarily stops the fourth conveyer R4.

Figure 12:
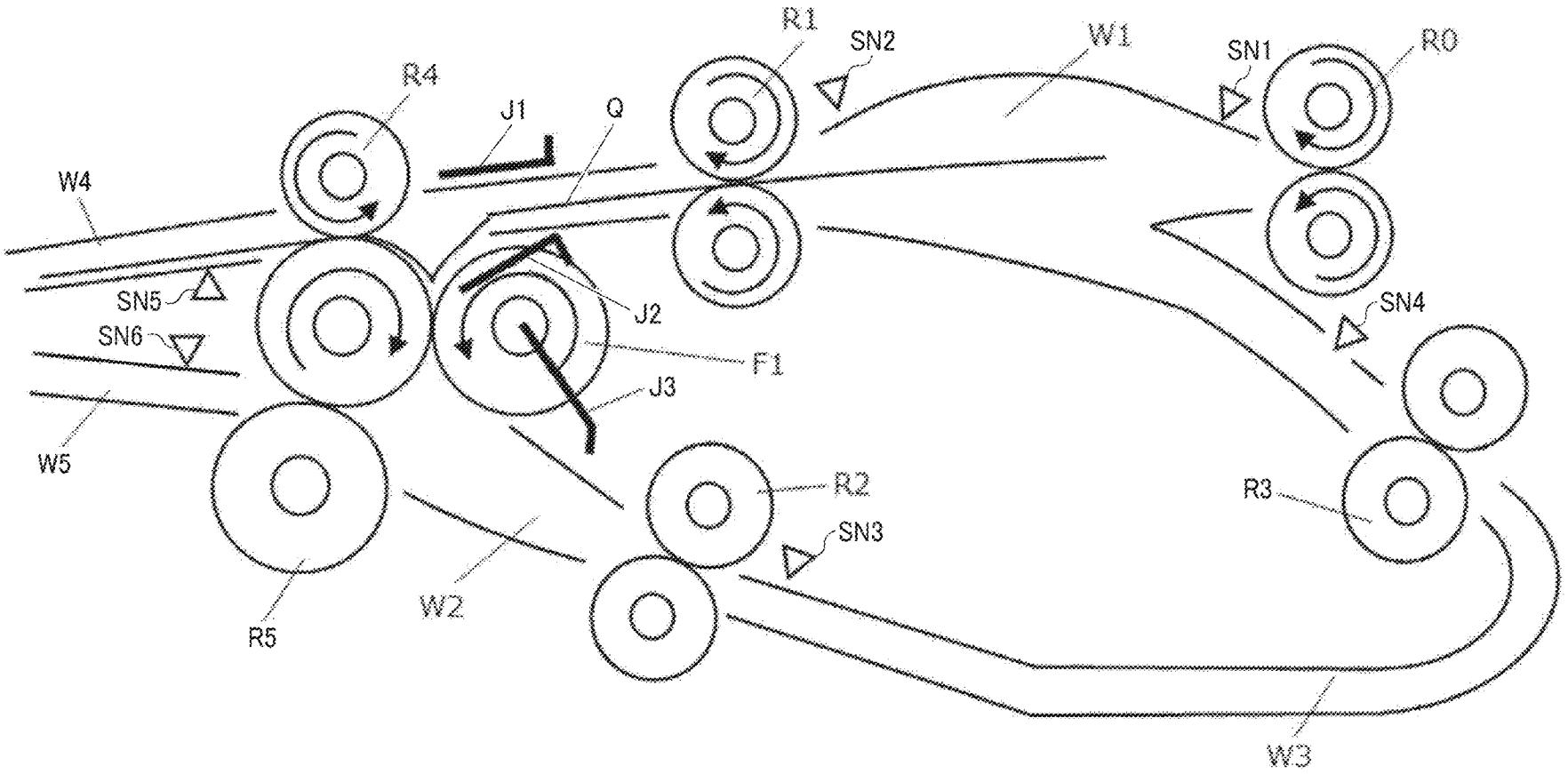
FIG. 12 is an enlarged view of the inner configuration of the sheet folding device according to the embodiment of the present disclosure, illustrating a folding operation next to the folding operation in FIG. 11.

Next, as illustrated in FIG. 12, the post-processing controller 50 reversely rotates the fourth conveyer R4 and the first folder F1 to convey the sheet bundle Q in a direction opposite to the conveyance direction illustrated in FIG. 11 while rotating the first conveyer R1 in the conveyance direction as illustrated in FIG. 11. The above-described reverse rotation of the fourth conveyer R4 conveys the sheet bundle Q in the direction opposite the conveyance direction.

Figure 13:
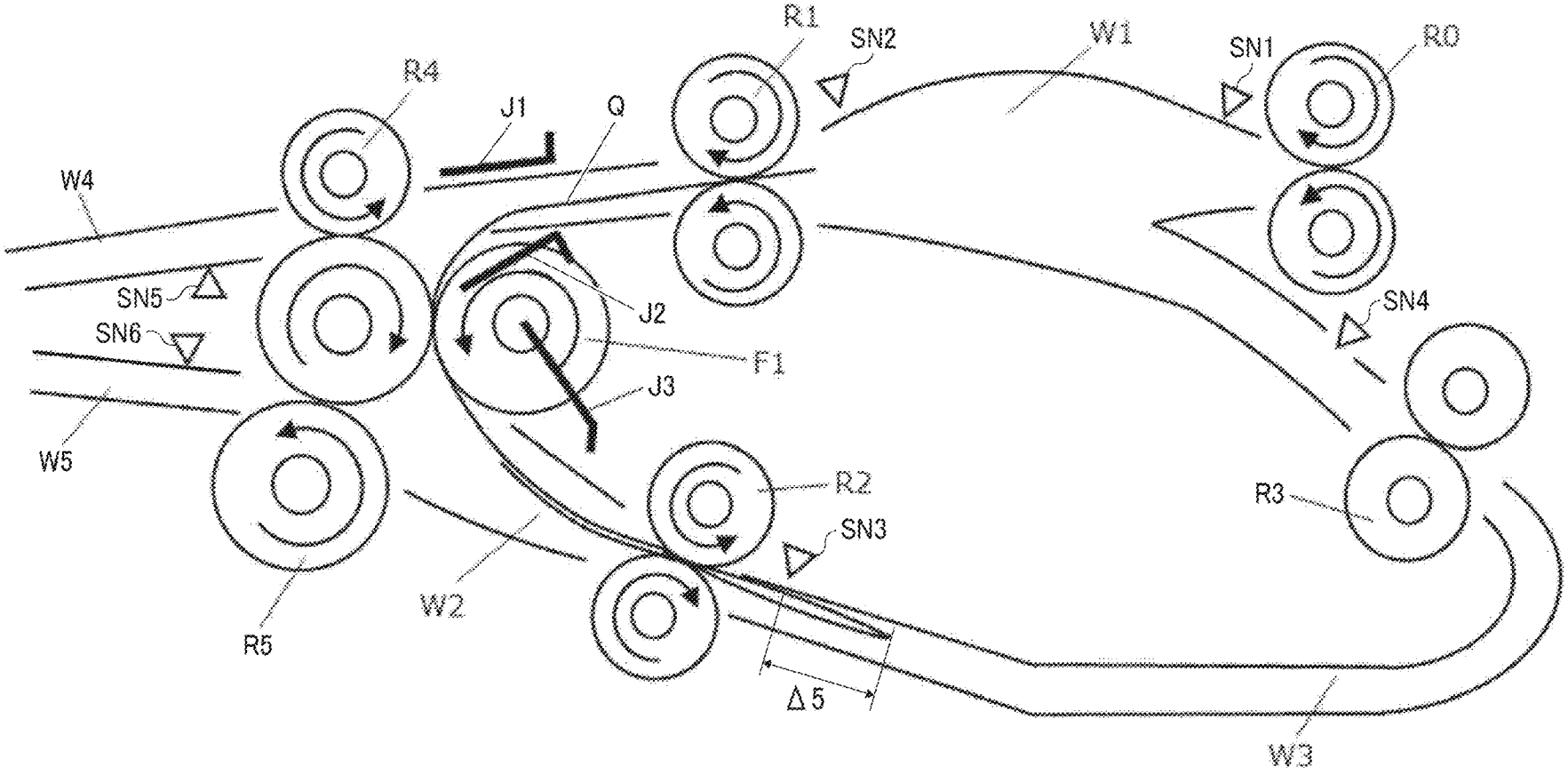
FIG. 13 is an enlarged view of the inner configuration of the sheet folding device according to the embodiment of the present disclosure, illustrating a folding operation next to the folding operation in FIG. 12.

As illustrated in FIG. 13, the first conveyer R1 rotates to convey the sheet bundle Q in the conveyance direction, and the fourth conveyer R4 rotates in reverse to convey the sheet bundle Q in the direction opposite to the conveyance direction. As a result, the sheet bundle Q forms a bend before the nip of the first folder F1. The bend enters the nip, and the first folder F1 performs the first folding, thereby forming the first fold line.

The first folder F1 conveys the sheet bundle Q performed the first folding to the second conveyance path W2, and the sheet bundle Q is conveyed along the downward slope of the second conveyance path W2. The second conveyer R2 conveys the leading edge of the sheet bundle Q by a fifth protrusion amount 45 after the third sheet detecting sensor SN3 detects the leading edge of the sheet bundle Q. When the second conveyer R2 conveys the leading edge of the sheet bundle Q by the fifth protrusion amount 45, the post-processing controller temporarily stops the second conveyer R2.

Figure 14:
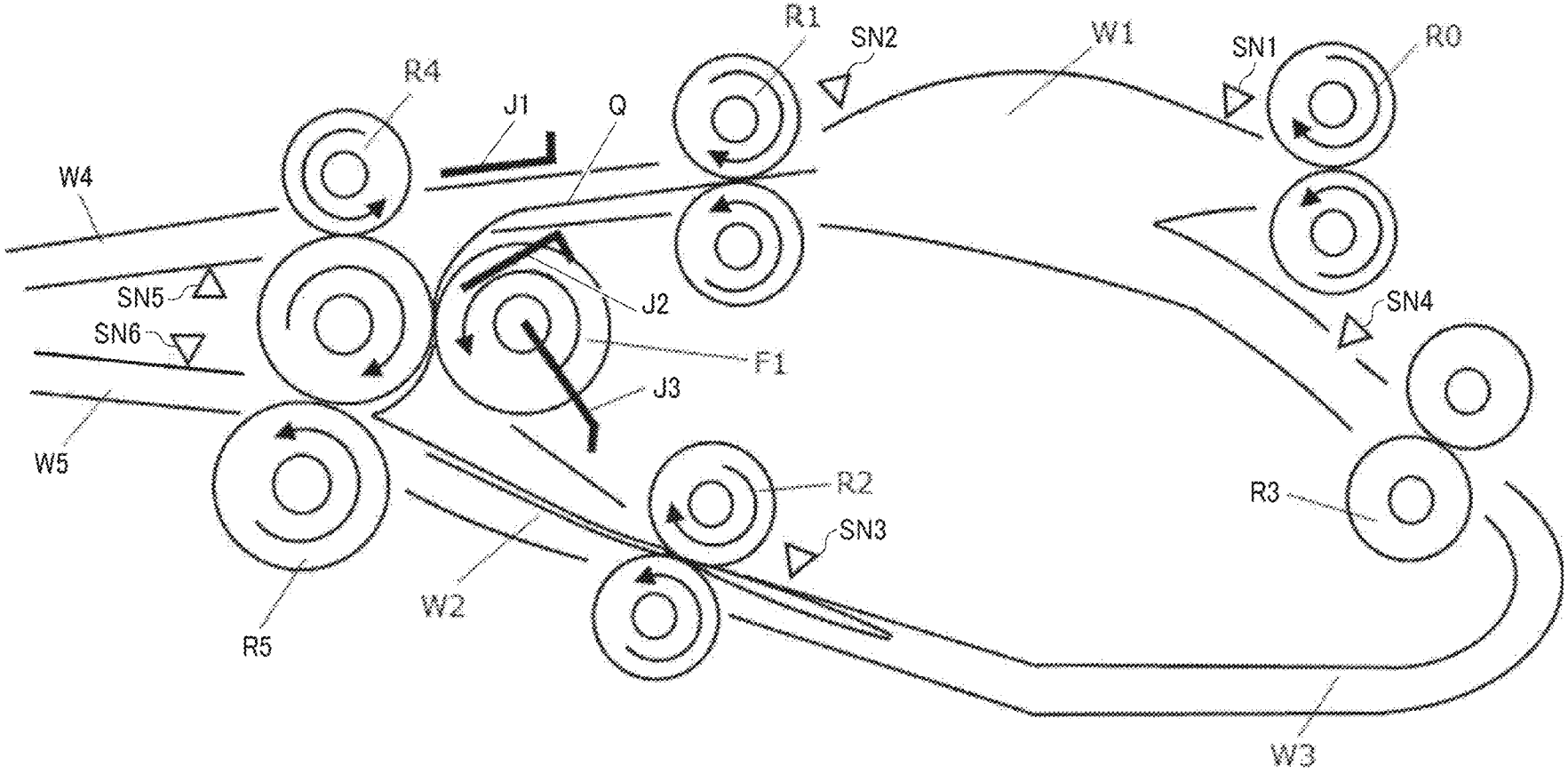
FIG. 14 is an enlarged view of the inner configuration of the sheet folding device according to the embodiment of the present disclosure, illustrating a folding operation next to the folding operation in FIG. 13.

Next, the post-processing controller 50 rotates the second conveyer R2 in the direction opposite to the direction illustrated in FIG. 13 while rotating the fourth conveyer R4 and the first folder F1 in the conveyance direction illustrated in FIG. 13. The above-described reverse rotation of the second conveyer R2 conveys the sheet bundle Q in the reverse direction from the second conveyer R2. In addition, the post-processing controller 50 rotates the fourth conveyer R4 and the first folder F1 in the direction illustrated in FIG. 13 to convey the sheet bundle Q. As a result, as illustrated in FIG. 14, a bend of the sheet bundle Q is formed before the nip of the second folder F2 that also functions the fifth conveyer R5. The bend enters the nip, and the second folder F2 performs the second folding, thereby forming the second fold line.

The sheet bundle Q on which the second folding is performed passes through the fifth conveyance path W5 and is conveyed to the output tray 24. The fourth protrusion amount and the fifth protrusion amount 45 are determined based on the total length of the sheet P and a folding method set for the sheet P (or the sheet bundle Q). The post-processing controller 50 determines whether the sheet P or the sheet bundle Q moves by the fourth protrusion amount 44 based on the rotation amount of the fourth conveyer R4 (that is, the number of drive steps of the drive motor) and determines whether the sheet P or the sheet bundle Q moves by the fifth protrusion amount 45 based on the rotation amount of the second conveyer R2 (that is, the number of drive steps of the drive motor).

When the sheet folding device 200 performs the letter fold-out operations on the sheet P, the sheet P is folded outside at a position corresponding to two thirds (⅔) of the entire length of the sheet P from the leading edge of the sheet P in the sheet conveyance direction as a first folding operation. Next, as a second folding operation, the sheet P is folded inside at a position corresponding to two thirds (⅔) of the entire length of the sheet P. When the sheet folding device 200 performs the letter fold-in operation on the sheet P, the sheet P is folded outside at a position corresponding to one third (⅓) of the entire length of the sheet P from the leading edge of the sheet P in the sheet conveyance direction as a first folding operation and folded inside at a position corresponding to two thirds (⅔) of the entire length of the sheet P as a second folding operation.

First Operation Example

Figure 15:
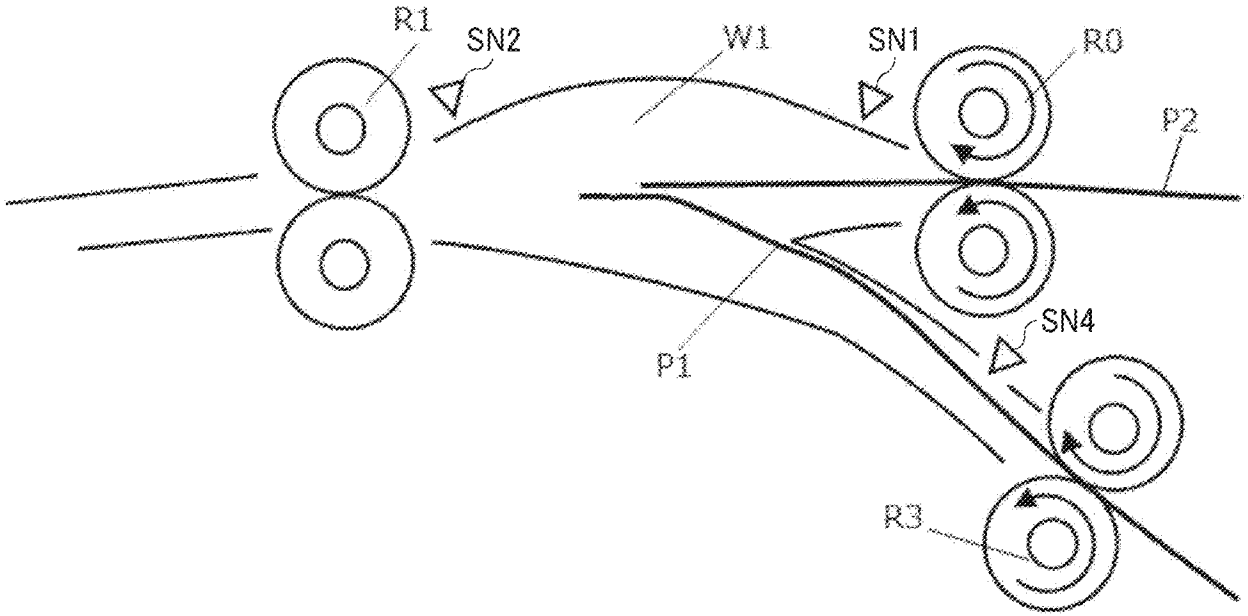
FIG. 15 is an enlarged view of the inner configuration of the sheet folding device to illustrate a preceding sheet that precedes a following sheet.
Figure 16:
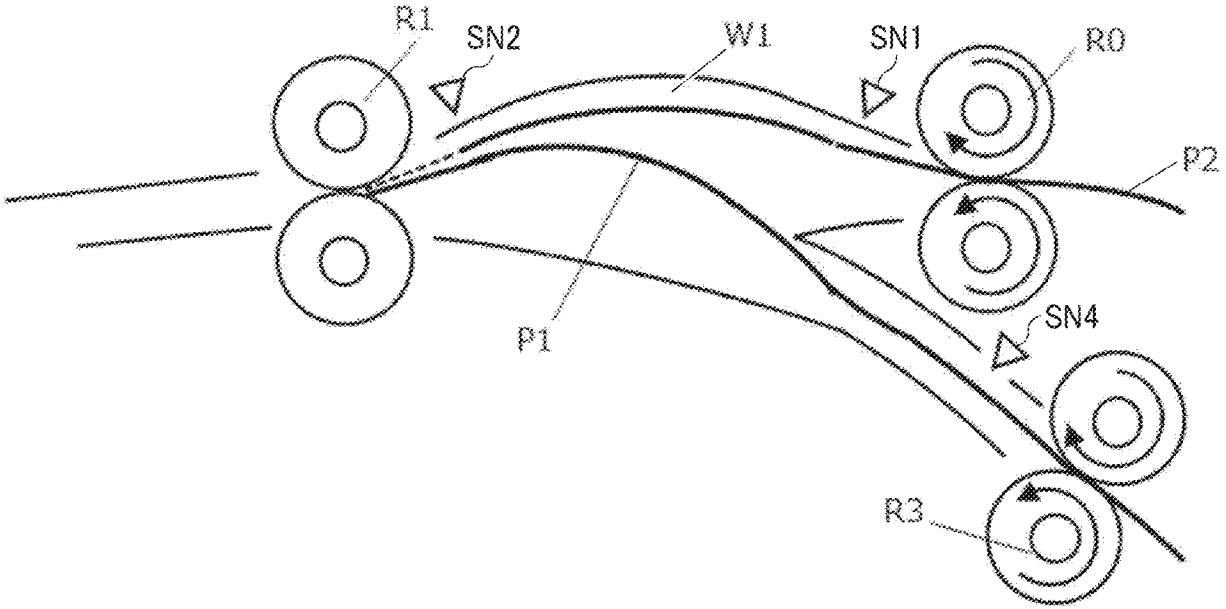
FIG. 16 is an enlarged view of the inner configuration of the sheet folding device to illustrate the preceding sheet pushing away the following sheet.

Next, a first operation example of the sheet folding device 200 according to the present embodiment is described with reference to FIGS. 15 to 18. With reference to FIGS. 15 and 16, movements of the preceding sheet P1 and the following sheet P2 are described when the leading edge of the preceding sheet P1 staying the third conveyance path W3 precedes the leading edge of the following sheet P2 and is shifted from the leading edge of the following sheet P2 in the sheet conveyance direction, and the preceding sheet P1 and the following sheet P2 are overlaid and conveyed.

As illustrated in FIG. 15, the leading edge of the preceding sheet P1 preceding the leading edge of the following sheet P2 strikes against a roller of the first conveyer R1 before the following sheet P2 contacts the first conveyer R1. The preceding sheet P1 bends as illustrated in FIG. 16 when the leading edge of the preceding sheet P1 strikes against the roller of the first conveyer R1. Since the following sheet P2 received from the image forming device 100 is positioned above the preceding sheet P1 in the first conveyance path W1, the above-described bending of the preceding sheet P1 causes a bending of the following sheet P2. As a result, as illustrated in FIG. 16, the preceding sheet P1 pushes away the following sheet P2, and the leading edge of the following sheet P2 does not reach the roller of the first conveyer R1 and does not strike the roller.

As a result, the skew correction of the following sheet P2 is insufficient, and the leading edges of sheets of the sheet bundle Q are misaligned when the following sheet P2 and the preceding sheet P1 are overlaid. The above-described problem also occurs when the leading edge of the following sheet P2 coincides the leading edge of the preceding sheet P1 staying on the third conveyance path W3. However, the above-described problem is caused by a variation of the first sheet detecting sensor SN1, a variation of the fourth sheet detecting sensor SN4, a curl of the sheet P, a mechanical variation in attachment position of each sensor, or the like. The above-described factors causes the preceding sheet P1 to precede the following sheet P2 when the preceding sheet P1 and the following sheet P2 are overlaid, and the above-described problem occurs.

Figure 17:
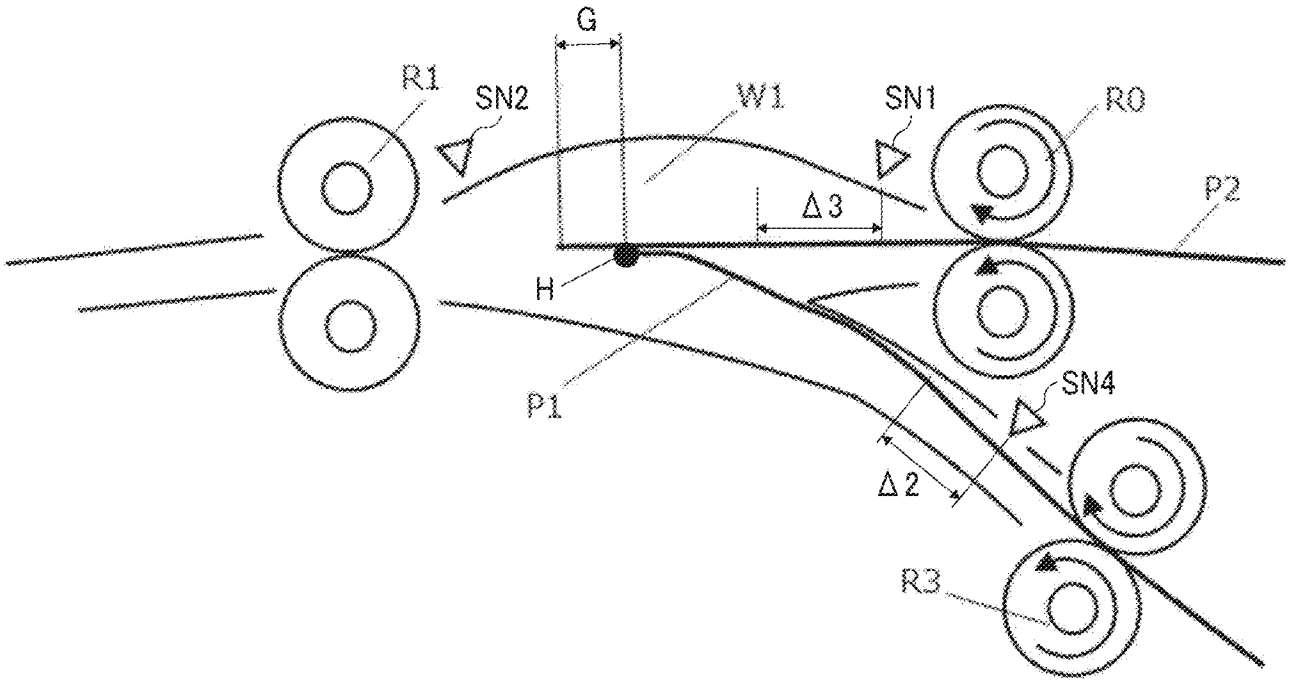
FIG. 17 is an enlarged view of the inner configuration of the sheet folding device according to the embodiment of the present disclosure to illustrate the following sheet that precedes the preceding sheet.
Figure 18:
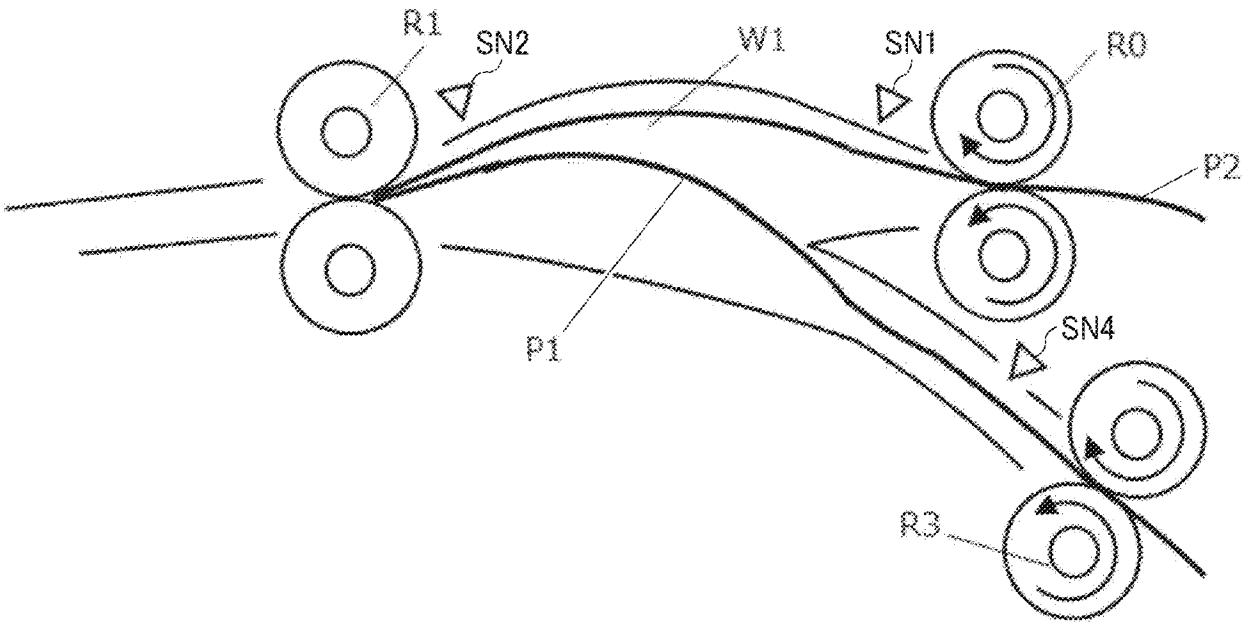
FIG. 18 is an enlarged view of the inner configuration of the sheet folding device according to the embodiment of the present disclosure, illustrating a process next to the process in FIG. 17.

With reference to FIGS. 17 and 18, movements of the preceding sheet P1 and the following sheet P2 are described when the leading edge of the following sheet P2 precedes the leading edge of the preceding sheet P1 and is shifted from the leading edge of the preceding sheet P1 by a length G in the sheet conveyance direction, and the preceding sheet P1 and the following sheet P2 are overlaid and conveyed. When the preceding sheet P1 and the following sheet P2 are conveyed as illustrated in FIG. 17, the leading edge of the following sheet P2 strikes the roller of the first conveyer R1 before the leading edge of the preceding sheet P1 contacts the first conveyer R1.

When the leading edge of the following sheet P2 strikes against the roller of the first conveyer R1, the following sheet P2 bends. However, since the preceding sheet P1 is below the following sheet P2 in the first conveyance path W1, the bending of the following sheet P2 does not affect the conveyance of the preceding sheet P1. Accordingly, the leading edge of the preceding sheet P1 and the leading edge of the following sheet P2 can reach the first conveyer R1. As a result, the above-described configuration can prevent the insufficient skew correction caused by the bending of the preceding sheet P1 as illustrated in FIG. 16 and the misalignment between the leading edges of the sheets to be overlaid.

Several methods are considered to determine a conveyance restart timing of the preceding sheet P1 staying on the third conveyance path W3. The following describes examples of the methods when the preceding sheet P1 and the following sheet P2 are conveyed at the same speed. In the following description, a point at which the leading edge of the preceding sheet P1 meets the following sheet P2 is referred to as a meeting point H as illustrated in FIG. 17. The distance from the meeting point H to the leading edge of the preceding sheet P1 protruding by the second protrusion amount 42 from the fourth sheet detecting sensor SN4 is set at a distance not less than the sum of the length G and the distance from the meeting point H to the leading edge of the following sheet P2 protruding by the third protrusion amount Δ3. The third conveyer R3 restarts rotation when the leading edge of the following sheet P2 reaches the position corresponding to the third protruding amount Δ3. As a result, the leading edge of the following sheet P2 precedes the leading edge of the preceding sheet P1 and is shifted from the leading edge of the preceding sheet P1 by the length G in the sheet conveyance direction, and the preceding sheet P1 and the following sheet P2 can be overlaid and conveyed. If a factor such as the layout of parts in the post-processing device prevents setting the distance from the meeting point H to the leading edge of the preceding sheet P1 that protrudes from the fourth sheet detecting sensor SN4 by the second protrusion amount 42 to be equal to or larger than the sum of the length G and the distance from the meeting point H to the leading edge of the following sheet P2 that protrudes from the first sheet detecting sensor SN1 by the third protrusion amount Δ3, the third conveyer R3 restarts rotation when the leading edge of the following sheet P2 is conveyed by the length G in addition to the third protrusion amount Δ3 from the first sheet detecting sensor SN1. As a result, the leading edge of the following sheet P2 precedes the leading edge of the preceding sheet P1 and is shifted from the leading edge of the preceding sheet P1 by the length G in the sheet conveyance direction, and the preceding sheet P1 and the following sheet P2 can be overlaid and conveyed.

Second Operation Example

Figure 19:
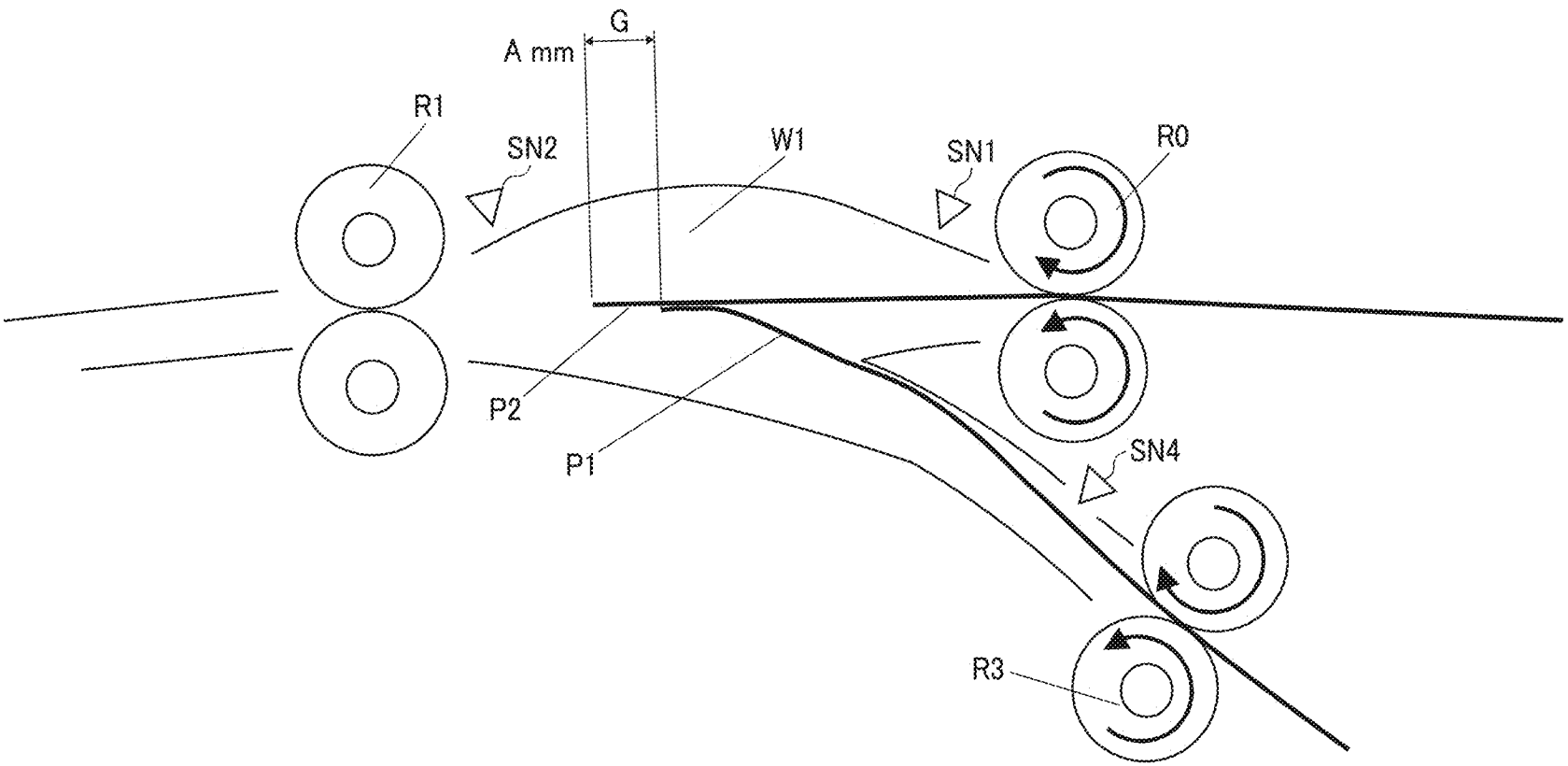
FIG. 19 is an enlarged view of the inner configuration of the sheet folding device according to the embodiment of the present disclosure to illustrate a shift amount when the preceding sheet and the following sheet are overlaid each other.
Figure 20:
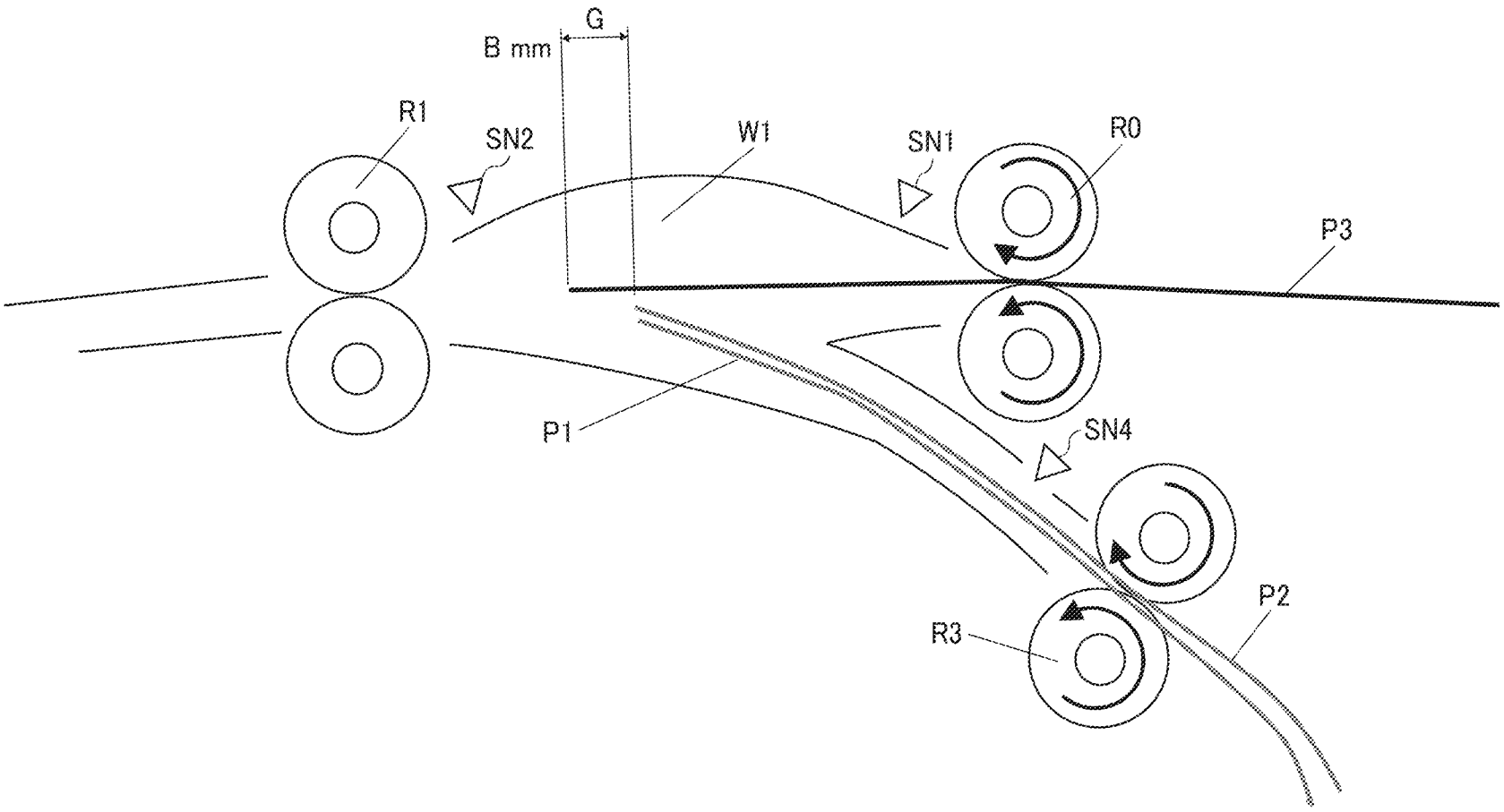
FIG. 20 is an enlarged view of the inner configuration of the sheet folding device according to the embodiment of the present disclosure to illustrate a shift amount when a next sheet is overlaid on the following sheet and the preceding sheet.

Next, a second operation example of the sheet folding device 200 according to the present embodiment is described with reference to FIGS. 19 to 21. With reference to FIGS. 19 to 21, the following describes a shift amount (that is, the length G) between the leading edge of the preceding sheet P1 and the leading edge of the following sheet P2 when the preceding sheet P1 and the following sheet P2 are overlaid.

In FIG. 19, the length G is set to be a shift amount A mm that is the shift amount between the leading edge of the preceding sheet P1 and the leading edge of the following sheet P2 when the preceding sheet P1 and the following sheet P2 are overlaid. The unit of the length G is millimeter. Hereinafter, the unit of the length G and the protrusion amounts is millimeter.

As illustrated in FIG. 19, the preceding sheet P1 is overlaid on the following sheet P2, and the leading edge of the following sheet P2 is shifted from the leading edge of the preceding sheet P1 by the shift amount A mm to form the sheet bundle Q. The sheet bundle Q strikes against the first conveyer R1 that is stopped. In this case, the post-processing controller 50 controls the conveyance of the sheet bundle Q so that the first protrusion amount 41 of the sheet bundle Q that strikes against the first conveyer R1 becomes "a mm".

After the sheet bundle Q strikes against the first conveyer R1, the post-processing controller drives and rotates the first conveyer R1 to convey the sheet bundle Q including the preceding sheet P1 and the following sheet P2 to the first folder F1. Subsequently, the post-processing controller 50 drives and rotates the first conveyer R1, the second conveyer R2, and the third conveyer R3 to convey the sheet bundle Q to the fourth sheet detecting sensor SN4.

Then, the post-processing controller 50 conveys the sheet bundle Q (the preceding sheet P1 and the following sheet P2) until the leading edge of the preceding sheet P1 or the following sheet P2 reaches a position corresponding to the second protrusion amount 42 that is a predetermined protrusion amount after the fourth sheet detecting sensor SN4 detects the leading edge of the preceding sheet P1 or the following sheet P2. The post-processing controller 50 stops the conveyance of the sheet bundle Q when the leading edge of the preceding sheet P1 or the following sheet P2 reaches the position corresponding to the second protrusion amount 42.

While the third conveyer R3 holds and stops the preceding sheet P1 and the following sheet P2, the next sheet P3 is conveyed next to the following sheet P2 from the image forming device 100 as illustrated in FIG. 20. In this case, the post-processing controller 50 monitors an elapsed time since the first sheet detecting sensor SN1 detects the leading edge of the next sheet P3.

After the elapsed time becomes a predetermined time, as illustrated in FIG. 20, the post-processing controller 50 drives the second conveyer R2 and the third conveyer R3 to overlay the preceding sheet P1 and the following sheet P2 onto the next sheet P3. When the sheet bundle Q including the preceding sheet P1 and the following sheet P2 is overlaid on the next sheet P3, the length G between the leading edge of the next sheet P3 and the leading edge of the sheet bundle Q is set to be a shift amount B mm. The shift amount B is shorter than the shift amount A, and the relationship of A>B is established.

Figure 21A:
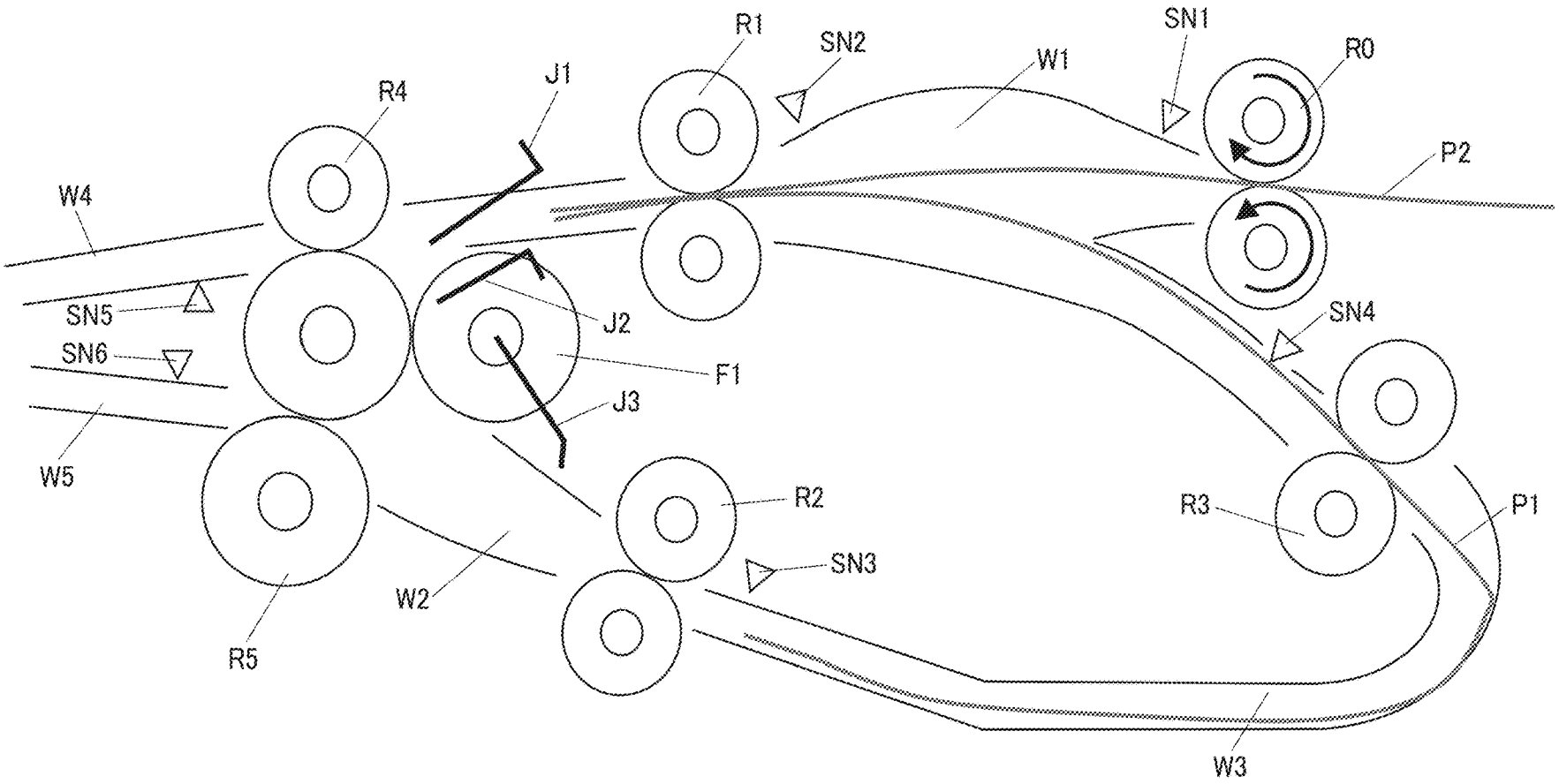
FIGS. 21A and 21B are enlarged views of the inner configuration of the sheet folding device in which the shift amount is not set.
Figure 21B:
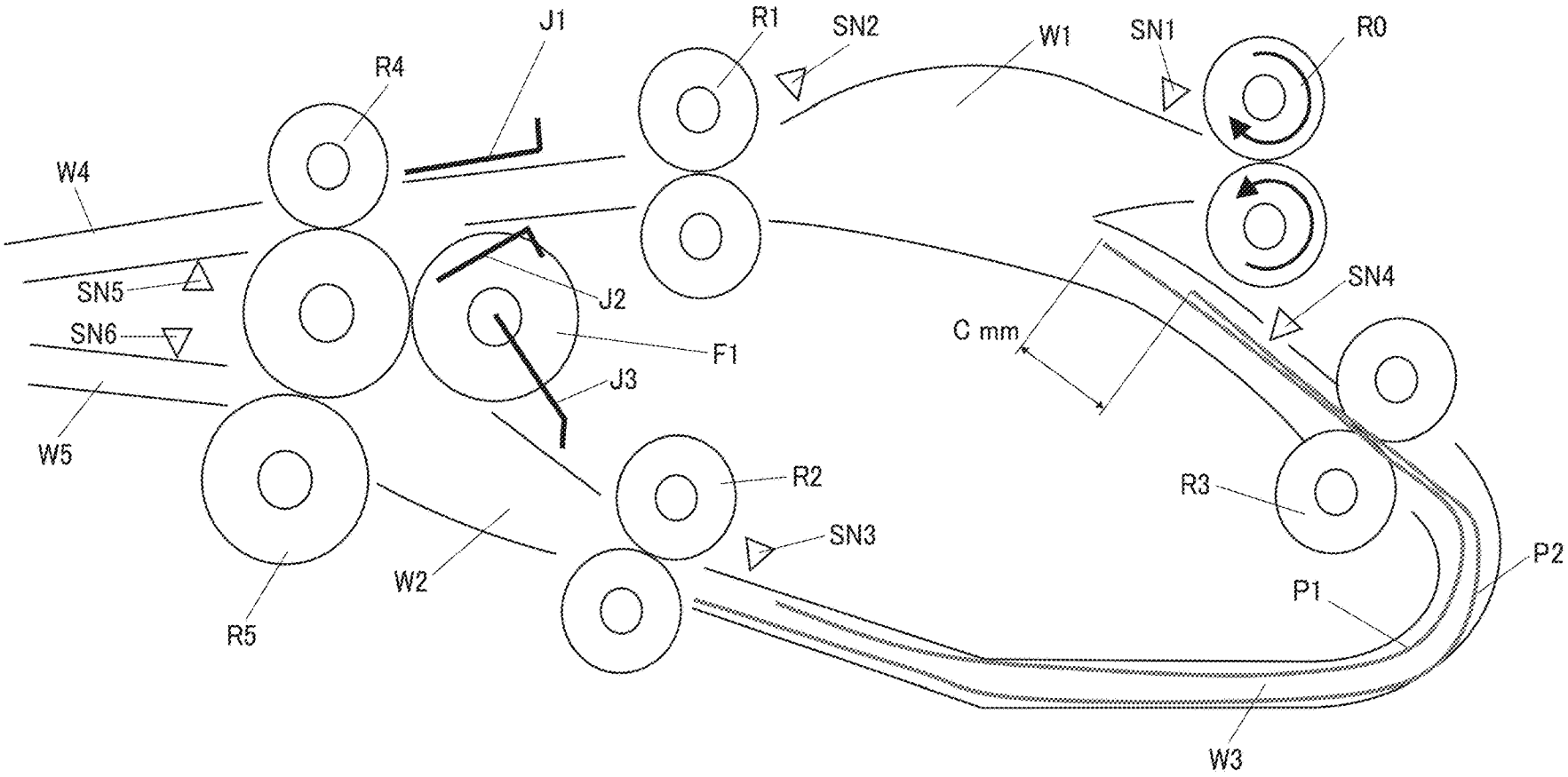

With reference to FIGS. 21A and 21B, the following describes the reason why the post-processing controller 50 performs the above-described control. As illustrated in FIG. 21A, it is assumed that the preceding sheet P1 and the following sheet P2 are brought into contact with the first conveyer R1 to correct each skew and neatly arrange the leading edges of the preceding sheet P1 and the following sheet P2, and then are conveyed along the circulation conveyance path to a position at which the fourth sheet detecting sensor SN4 detects the preceding sheet P1 or the following sheet P2. At this time, the preceding sheet P1 passes through an inner route in the circulation conveyance path, and the following sheet P2 passes through an outer route in the circulation conveyance path. That is, the movement of the preceding sheet P1 is shorter than the movement of the following sheet P2 like a difference in a car between track followed by front and back inner wheels when turning.

As a result, as illustrated in FIG. 21B, the preceding sheet P1 precedes the following sheet P2 when the fourth sheet detecting sensor SN4 detects the leading edge of the preceding sheet P1 or the following sheet P2 even if the leading edge of the preceding sheet P1 and the leading edge of the following sheet P2 are aligned in the nip of the first conveyer R1. A preceding amount C mm illustrated in FIG. 21B is not limited to an amount caused by the above-described difference and is also caused by variations in positions at which the leading edges of the preceding sheet P1 and the following sheet P2 enter the nips of the first to third conveyers. The variations are increased by curls of the preceding sheet P1 and the following sheet P2.

In order to align the leading edge of the preceding sheet P1 and the leading edge of the following sheet P2 when the fourth sheet detecting sensor SN4 detects the leading edge of the preceding sheet P1 or the leading edge of the following sheet P2, post-processing controller controls the zeroth conveyer R0 and the third conveyer R3 so that the leading edge of the following sheet P2 precedes the leading edge of the preceding sheet P1 by the preceding amount C mm. The preceding amount C mm corresponds to a shift amount between the leading edges of the preceding sheet P1 and the following sheet P2 when the preceding sheet P1 and the following sheet P2 are conveyed downstream from the first conveyer R1.

Based on the above, the shift amount A mm between the leading edge of the preceding sheet P1 and the leading edge of the following sheet P2 when the preceding sheet P1 meets the following sheet P2 is calculated as a sum of "a mm" as the first protrusion amount Δ1, the preceding amount C mm. and "+α mm" as a margin. The shift amount B mm between the leading edge of the next sheet P3 and the leading edge of the sheet bundle Q (that includes the preceding sheet P1 and the following sheet P2) when the next sheet P3 meets the sheet bundle Q is calculated as a sum of "a mm" as the first protrusion amount Δ1 of the next sheet P3 and "+α mm" as the margin.

In the above-described embodiment, the three sheets P are overlaid. When four or more sheets P are overlaid, the shift amount regarding the sheet P that is finally overlaid (that is, the final sheet PL) is different from the shift amount regarding the sheet that is not finally overlaid.

First Example of Control Flow of Sheet Folding Device 200

Next, examples of control flows of the sheet folding device 200 is described. The post-processing controller 50 performs control programs including control flows described below.

Figure 22:
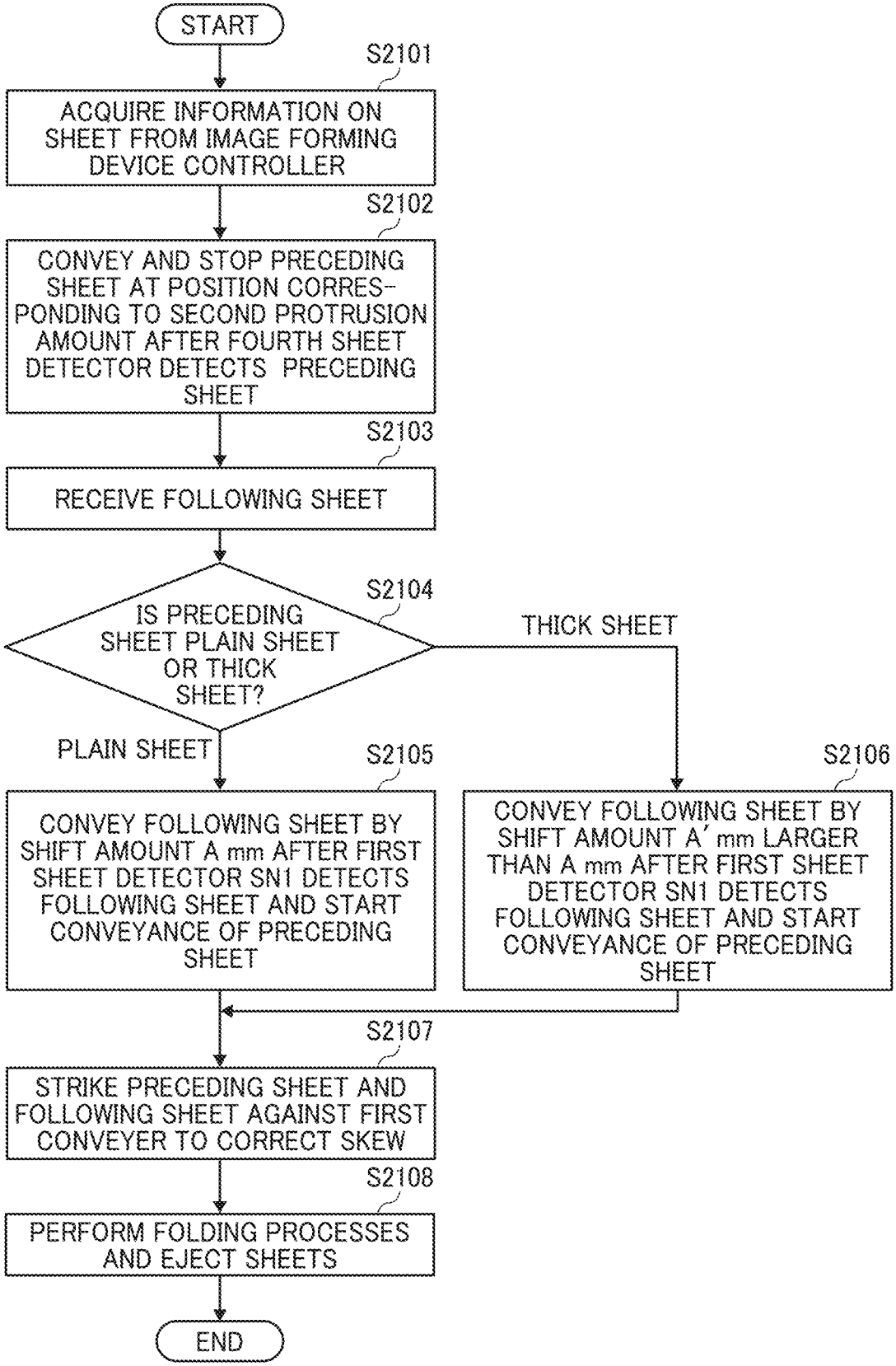
FIG. 22 is a flowchart of a control according to a first example performed by the sheet folding device.

FIG. 22 is a flowchart illustrating a first example of a control flow of the sheet folding device 200. First, the post-processing controller 50 acquires information on the sheet P from the image forming device controller 10 in step S2101. Subsequently, the preceding sheet P1 is conveyed in the sheet circulation path, and the fourth sheet detecting sensor SN4 detects the leading edge of the preceding sheet P1. The post-processing controller 50 stops conveying the preceding sheet P1 that reaches the position corresponding to the second protrusion amount Δ2 after the fourth sheet detecting sensor SN4 detects the leading edge of the preceding sheet P1 in step S2102.

In step S2103, the sheet folding device 200 receives the following sheet P2. In step S2104, the post-processing controller 50 determines the type of the preceding sheet P1.

When the post-processing controller 50 determines that the preceding sheet P1 is a plain sheet, the post-processing controller 50 sets the third protrusion amount Δ3 to be the shift amount A mm. The third protrusion amount Δ3 is a protrusion amount of the leading edge of the following sheet P2 from the position of the first sheet detecting sensor SN1 after the first sheet detecting sensor SN1 detects the leading edge of the following sheet P2. Then, after the third protrusion amount Δ3 with respect to the following sheet P2 reaches the shift amount A mm, the post-processing controller 50 resumes the rotation of the third conveyer R3 and causes the preceding sheet P1 to meet the following sheet P2 in the first conveyance path W1 in step S2105.

When the post-processing controller 50 determines that the preceding sheet P1 is the thick sheet, the post-processing controller 50 sets the third protrusion amount Δ3 to be the shift amount A' mm larger than the shift amount A mm. Then, after the third protrusion amount Δ3 with respect to the following sheet P2 reaches the shift amount A' mm, the post-processing controller 50 resumes the rotation of the third conveyer R3 and causes the preceding sheet P1 to meet the following sheet P2 in the first conveyance path W1 in step S2106.

When the preceding sheet is the thick sheet, the thickness of the preceding sheet P1 increases a conveyance distance of the following sheet P2 until the following sheet P2 is conveyed to the position of the fourth sheet detecting sensor SN4 after the following sheet is overlaid on the preceding sheet P1, and the conveyance distance of the following sheet P2 overlaid on the thick sheet is longer than the conveyance distance of the following sheet P2 overlaid on the plain sheet. In the first example, the third protrusion amount Δ3 is set to be the shift amount A' mm to increase the shift amount between the leading edge of the preceding sheet P1 and the leading edge of the following sheet P2 in advance. The above-described control reduces the distance between the leading edge of the preceding sheet P1 and the leading edge of the following sheet P2 when the preceding sheet P1 and the following sheet P2 reaches the position at which the fourth sheet detecting sensor SN4 detects the preceding sheet P1 or the following sheet P2.

In the first conveyance path W1, the preceding sheet P1 meets the following sheet P2, and the preceding sheet P1 and the following sheet P2 strike against the first conveyer R1 that is stopped to correct the skew in step S2107.

In step S2108, the post-processing controller 50 performs the folding processing as described above when the folding processing is performed, and ejects the sheet bundle Q.

Second Example of Control Flow of Sheet Folding Device 200

Figure 23:
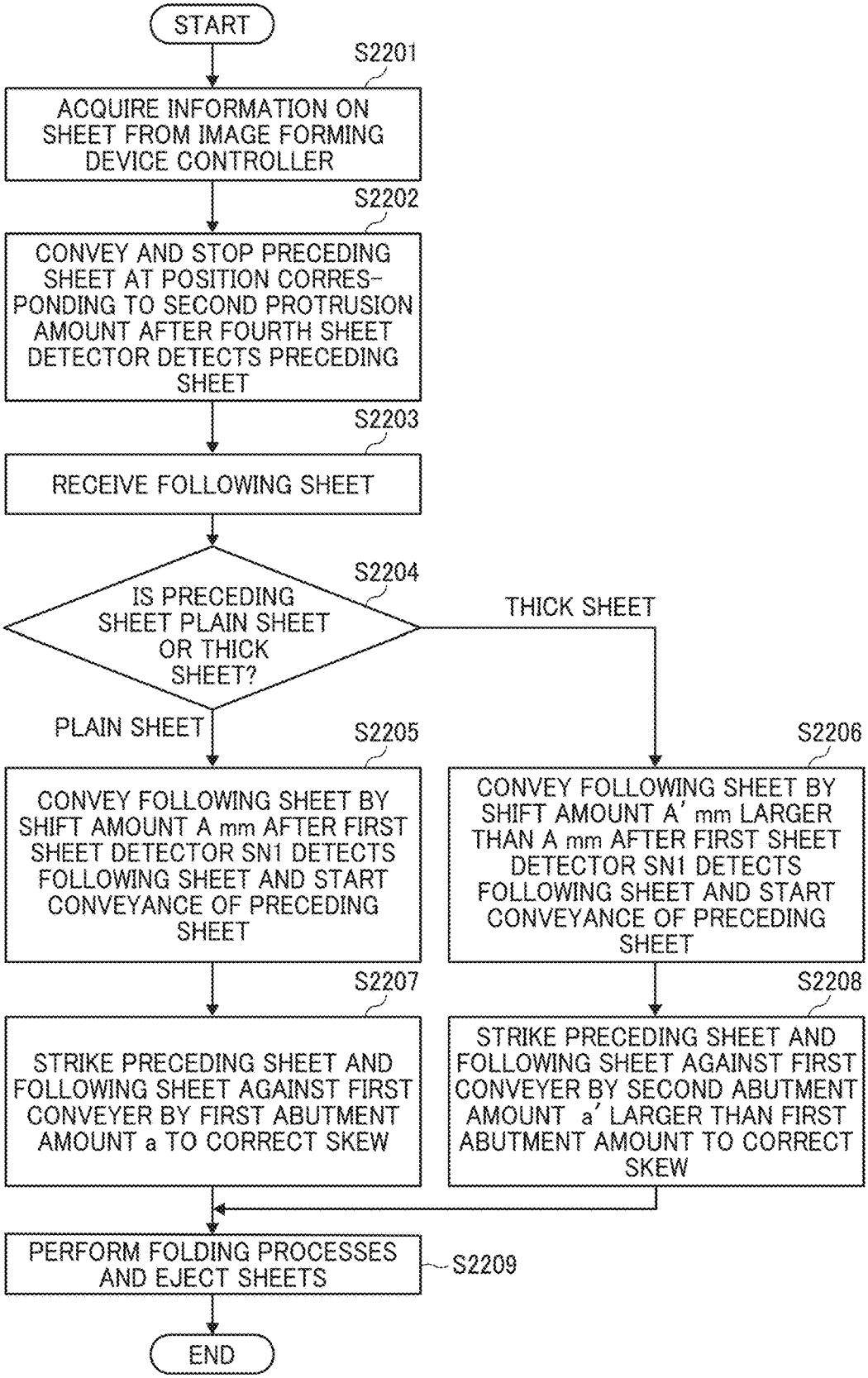
FIG. 23 is a flowchart of a control according to a second example performed by the sheet folding device.

FIG. 23 is a flowchart illustrating a second example of a control flow of the sheet folding device 200. First, the post-processing controller 50 acquires information on the sheet P from the image forming device controller 10 in step S2201. Subsequently, the preceding sheet P1 is conveyed in the sheet circulation path, and the fourth sheet detecting sensor SN4 detects the leading edge of the preceding sheet P1. The post-processing controller 50 stops conveying the preceding sheet P1 that reaches the position corresponding to the second protrusion amount 42 after the fourth sheet detecting sensor SN4 detects the leading edge of the preceding sheet P1 in step S2202.

In step S2203, the sheet folding device 200 receives the following sheet P2. In step S2204, the post-processing controller 50 determines the type of the preceding sheet P1.

When the post-processing controller 50 determines that the preceding sheet P1 is a plain sheet, the post-processing controller 50 sets the third protrusion amount Δ3 to be the shift amount A mm. Then, after the third protrusion amount Δ3 with respect to the following sheet P2 reaches the shift amount A mm, the post-processing controller 50 resumes the rotation of the third conveyer R3 and causes the preceding sheet P1 to meet the following sheet P2 in the first conveyance path W1 in step S2205.

In the first conveyance path W1, the preceding sheet P1 meets the following sheet P2, and the preceding sheet P1 and the following sheet P2 strike against the first conveyer R1 that is stopped to correct the skew in step S2207. In step S2207, the post-processing controller 50 controls the conveyance of the sheet bundle Q so that the first protrusion amount 41 of the sheet bundle Q that strikes against the first conveyer R1 becomes "a mm".

When the post-processing controller 50 determines that the preceding sheet P1 is the thick sheet, the post-processing controller 50 sets the third protrusion amount Δ3 to be the shift amount A' mm larger than the shift amount A mm. Then, after the third protrusion amount Δ3 with respect to the following sheet P2 reaches the shift amount A' mm, the post-processing controller 50 resumes the rotation of the third conveyer R3 and causes the preceding sheet P1 to meet the following sheet P2 in the first conveyance path W1 in step S2206.

In the first conveyance path W1, the preceding sheet P1 meets the following sheet P2, and the preceding sheet P1 and the following sheet P2 strike against the first conveyer R1 that is stopped to correct the skew in step S2208. In step S2208, the post-processing controller 50 controls the conveyance of the sheet bundle Q so that the first protrusion amount 41 of the sheet bundle Q that strikes against the first conveyer R1 becomes "a' mm" larger than "a mm".

After step S2207 or step S2208, the post-processing controller 50 performs the folding processing as described above when the folding processing is performed and ejects the sheet bundle Q in step S2209.

When the next sheet P3 meets the sheet bundle Q including the preceding sheet P1 and the following sheet P2 to form the new sheet bundle that strikes against the first conveyer R1 stopped, the post-processing controller 50 sets the first protrusion amount 41 to be a length longer than "a' mm".

That is, when the post-processing controller 50 changes the shift amount between the leading edge of the preceding sheet P1 and the leading edge of the following sheet P2 to "A'" based on the information about the type of the sheet, the post-processing controller 50 increases the first protrusion amount 41 of the next sheet P3 that is overlaid on the following sheet P2 and the preceding sheet P1. The above-described control enables correcting the skews of the preceding sheet P1 and the following sheet P2 during the correction of the skew of the next sheet P3. As a result, the above-described control can improve the accuracy of the alignment of the leading edges.

Third Example of Control Flow of Sheet Folding Device 200

Figure 24:
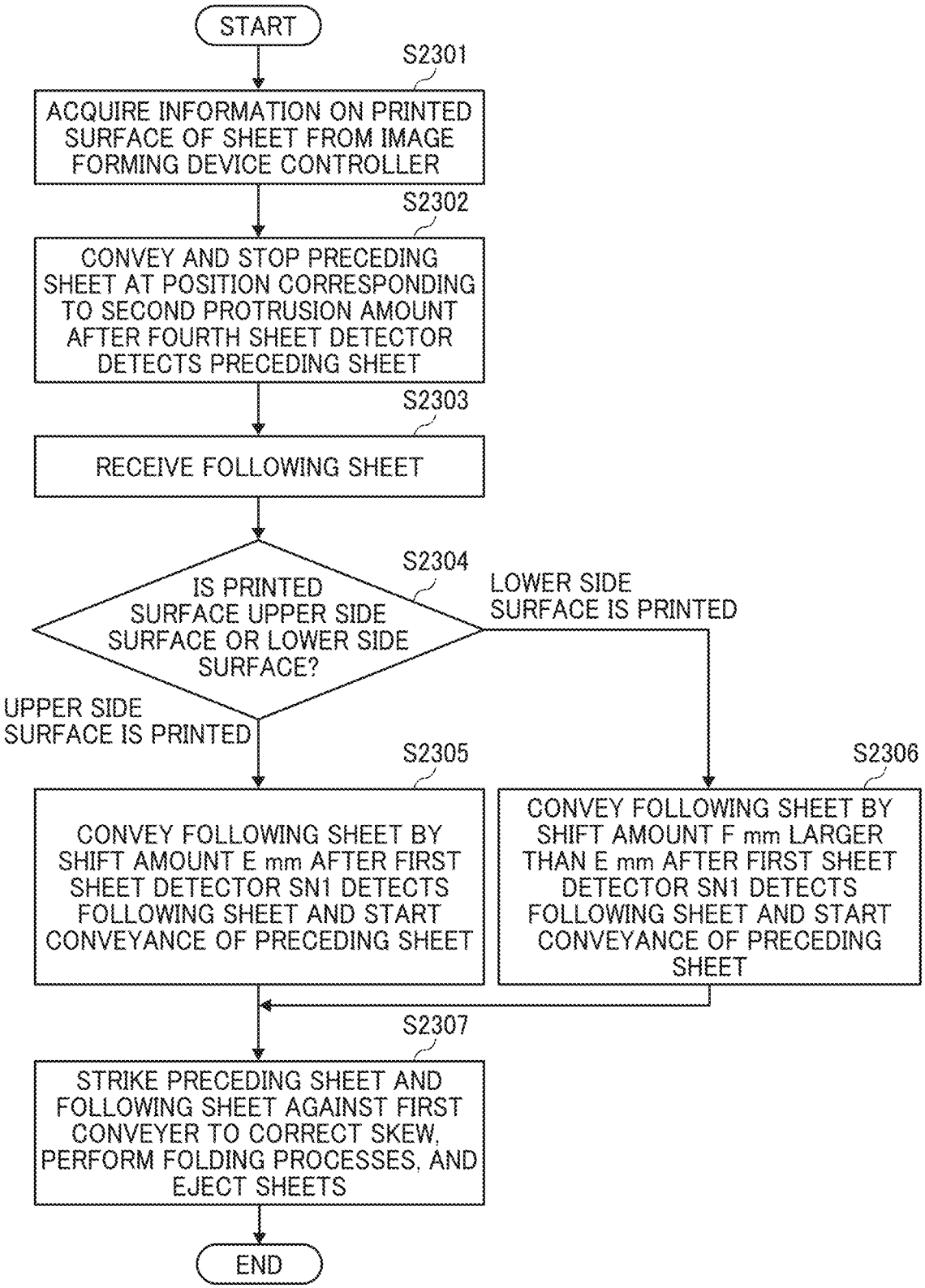
FIG. 24 is a flowchart of a control according to a third example performed by the sheet folding device.

FIG. 24 is a flowchart illustrating a third example of a control flow of the sheet folding device 200. First, the post-processing controller 50 acquires information on a printed surface of the sheet as the information on the sheet P from the image forming device controller 10 in step S2301. Subsequently, the preceding sheet P1 is conveyed in the sheet circulation path, and the fourth sheet detecting sensor SN4 detects the leading edge of the preceding sheet P1. The post-processing controller 50 stops conveying the preceding sheet P1 that reaches the position corresponding to the second protrusion amount 42 after the fourth sheet detecting sensor SN4 detects the leading edge of the preceding sheet P1 in step S2302.

In step S2303, the sheet folding device 200 receives the following sheet P2. In step S2304, the post-processing controller 50 determines whether the printed surface of the preceding sheet P1 is an upper surface or a lower surface.

When the post-processing controller 50 determines that the printed surface of the preceding sheet P1 is the upper surface of the preceding sheet P1, the post-processing controller 50 sets the third protrusion amount Δ3 to be the shift amount E mm. Then, after the third protrusion amount Δ3 with respect to the following sheet P2 reaches the shift amount E mm, the post-processing controller 50 resumes the rotation of the third conveyer R3 and causes the preceding sheet P1 to meet the following sheet P2 in the first conveyance path W1 in step S2305.

When the post-processing controller 50 determines that the printed surface of the preceding sheet P1 is the lower surface of the preceding sheet P1, the post-processing controller 50 sets the third protrusion amount Δ3 to be the shift amount F mm larger than the shift amount E mm. Then, after the third protrusion amount Δ3 with respect to the following sheet P2 reaches the shift amount F mm, the post-processing controller 50 resumes the rotation of the third conveyer R3 and causes the preceding sheet P1 to meet the following sheet P2 in the first conveyance path W1 in step S2306.

In the first conveyance path W1, the preceding sheet P1 meets the following sheet P2, and the preceding sheet P1 and the following sheet P2 strike against the first conveyer R1 that is stopped to correct the skew in step S2307. In addition, the post-processing controller 50 performs the folding processing as described above when the folding processing is performed, and ejects the sheet bundle Q in step S2307.

In this example, the post-processing controller 50 changes the shift amount between the leading edge of the preceding sheet P1 and the leading edge of the following sheet P2 based on a state of the printed surface of the overlaid sheet. The post-processing controller 50 receives the information about the printed surface of the sheet P that is a surface of the sheet on which the image is formed from the image forming device controller 10.

When the printed surface is the upper surface of the preceding sheet P1, the post-processing controller 50 controls the zeroth conveyer R0 and the third conveyer R3 so that the shift amount between the leading edge of the preceding sheet P1 and the leading edge of the following sheet P2 becomes E mm. When the printed surface is the lower surface of the preceding sheet P1, the post-processing controller 50 controls the zeroth conveyer R0 and the third conveyer R3 so that the shift amount between the leading edge of the preceding sheet P1 and the leading edge of the following sheet P2 becomes F mm. In the above-described both cases, the preceding sheet P1 precedes the following sheet P2 so as to make a relationship of F mm>E mm.

When the printed surface is the upper surface of the preceding sheet P1, if the image forming process is performed by the electrophotographic method, toner adhering to an image on the printed surface affects and reduces the friction between the sheets P. As a result, when the folding process is performed on the sheet bundle Q, the following sheet P2 slips, and the leading edges of the sheets overlaid in the sheet bundle Q are shifted. In anticipation of this, shifting the sheet P in advance can reduce the shift after the folding processing.

Fourth Example of Control Flow of Sheet Folding Device 200

Figure 25:
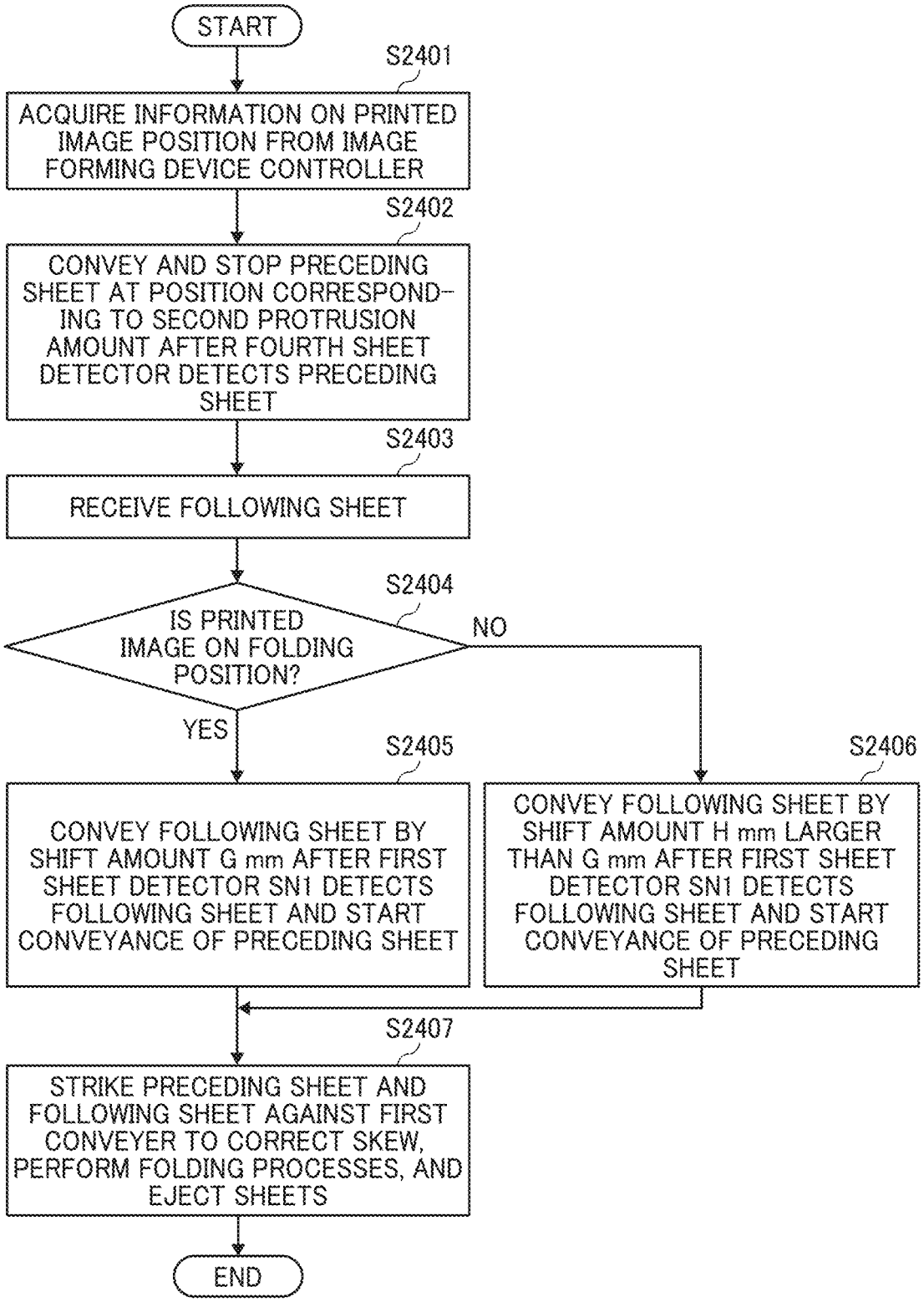
FIG. 25 is a flowchart of a control according to a fourth example performed by the sheet folding device.

FIG. 25 is a flowchart illustrating a fourth example of a control flow of the sheet folding device 200. First, the post-processing controller 50 acquires information on printed image positions on the sheet P as the information on the sheet P from the image forming device controller 10 in step S2401. Subsequently, the preceding sheet P1 is conveyed in the sheet circulation path, and the fourth sheet detecting sensor SN4 detects the leading edge of the preceding sheet P1. The post-processing controller 50 stops conveying the preceding sheet P1 that reaches the position corresponding to the second protrusion amount 42 after the fourth sheet detecting sensor SN4 detects the leading edge of the preceding sheet P1 in step S2402.

In step S2403, the sheet folding device 200 receives the following sheet P2. In step S2404, the post-processing controller 50 determines whether the printed image is on a folding position.

When the post-processing controller 50 determines that the printed image is on the folding position (Yes in step S2404), the post-processing controller 50 sets the third protrusion amount Δ3 to be the shift amount G mm. Then, after the third protrusion amount Δ3 with respect to the following sheet P2 reaches the shift amount G mm, the post-processing controller 50 resumes the rotation of the third conveyer R3 and causes the preceding sheet P1 to meet the following sheet P2 in the first conveyance path W1 in step S2405.

When the post-processing controller 50 determines that the printed image is not on the folding position (No in step S2404), the post-processing controller 50 sets the third protrusion amount to be a shift amount H mm larger than G mm. Then, after the third protrusion amount Δ3 with respect to the following sheet P2 reaches the shift amount H mm, the post-processing controller 50 resumes the rotation of the third conveyer R3 and causes the preceding sheet P1 to meet the following sheet P2 in the first conveyance path W1 in step S2406.

In the first conveyance path W1, the preceding sheet P1 meets the following sheet P2, and the preceding sheet P1 and the following sheet P2 strike against the first conveyer R1 that is stopped to correct the skew in step S2407. In addition, the post-processing controller 50 performs the folding processing as described above when the folding processing is performed, and ejects the sheet bundle Q in step S2407.

In this example, the post-processing controller 50 receives the information on the printed image positions from the image forming device 100. When the printed image is on the folding position of the sheet P, the post-processing controller 50 changes the shift amount between the leading edge of the preceding sheet P1 and the leading edge of the following sheet P2 to "G mm". When the printed image is not on the folding position of the sheet P, the post-processing controller 50 changes the shift amount between the leading edge the preceding sheet P1 and the leading edge of the following sheet P2 to "H mm". Regardless of the shift amount, the preceding sheet P1 is shifted in advance.

When the printed image is on the folding position, if the image forming process is performed by the electrophotographic method, toner adhering to the image on the printed surface affects and reduces the friction between the sheets P. As a result, when the folding process is performed on the sheet bundle Q, the following sheet P2 slips, and the leading edges of the sheets overlaid in the sheet bundle Q are shifted. In anticipation of this, shifting the sheet P in advance can reduce the shift after the folding processing.

Fifth Example of Control Flow of Sheet Folding Device 200

Figure 26:
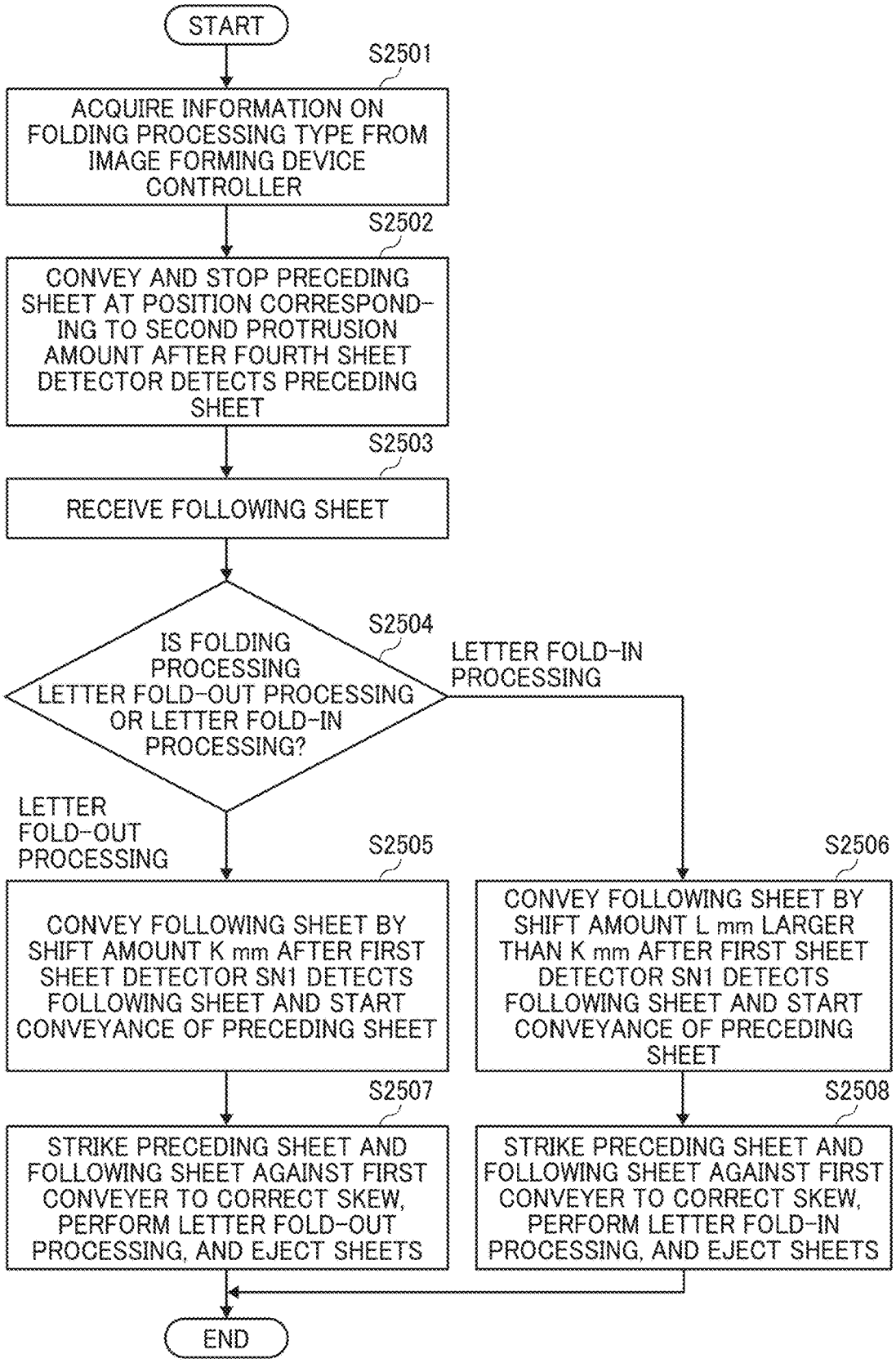
FIG. 26 is a flowchart of a control according to a fifth example performed by the sheet folding device.

FIG. 26 is a flowchart illustrating a fifth example of a control flow of the sheet folding device 200. First, the post-processing controller 50 acquires information on a folding type as the information on the sheet P from the image forming device controller 10 in step S2501. Subsequently, the preceding sheet P1 is conveyed in the sheet circulation path, and the fourth sheet detecting sensor SN4 detects the leading edge of the preceding sheet P1. The post-processing controller 50 stops conveying the preceding sheet P1 that reaches the position corresponding to the second protrusion amount 42 after the fourth sheet detecting sensor SN4 detects the leading edge of the preceding sheet P1 in step S2502.

In step S2503, the sheet folding device 200 receives the following sheet P2. In step S2504, the post-processing controller 50 determines what the folding type is.

When the post-processing controller 50 determines that the folding type is letter fold-out, the post-processing controller 50 sets the third protrusion amount Δ3 to be the shift amount K mm. Then, after the third protrusion amount Δ3 with respect to the following sheet P2 reaches the shift amount K mm, the post-processing controller 50 resumes the rotation of the third conveyer R3 and causes the preceding sheet P1 to meet the following sheet P2 in the first conveyance path W1 in step S2505.

In the first conveyance path W1, the preceding sheet P1 meets the following sheet P2, and the preceding sheet P1 and the following sheet P2 strike against the first conveyer R1 that is stopped to correct the skew in step S2507.

When the post-processing controller 50 determines that the folding type is not letter fold-out, the post-processing controller 50 sets the third protrusion amount Δ3 to be the shift amount L mm larger than K mm. Then, after the third protrusion amount Δ3 with respect to the following sheet P2 reaches the shift amount L mm, the post-processing controller 50 resumes the rotation of the third conveyer R3 and causes the preceding sheet P1 to meet the following sheet P2 in the first conveyance path W1 in step S2506.

In the first conveyance path W1, the preceding sheet P1 meets the following sheet P2, and the preceding sheet P1 and the following sheet P2 strike against the first conveyer R1 that is stopped to correct the skew in step S2508. Thereafter, the sheet folding device performs letter fold-in processing designated, and the sheet bundle Q is ejected in step S2508.

In this example, the post-processing controller 50 receives the information on the folding type from the image forming device 100. When the folding type is letter fold-out, the post-processing controller 50 changes the shift amount between the leading edge of the preceding sheet P1 and the leading edge of the following sheet P2 to "K mm". When the folding type is letter fold-in, the post-processing controller 50 changes the shift amount between the leading edge of the preceding sheet P1 and the leading edge of the following sheet P2 to "L mm". Regardless of the shift amount, the preceding sheet P1 is shifted in advance.

Setting the shift amount between the leading edge of the preceding sheet P1 and the leading edge of the following sheet P2 in the letter fold-in processing larger than that in the letter fold-out can improve the accuracy of the alignment of the leading edges after the folding processing is completed.

The sheet folding device 200 according to the present embodiment described above can improve accuracy of a skew correction of sheets overlaid and the accuracy of the alignment of the leading edges of the sheets overlaid when the post-processing device performs post processing including processes overlaying a plurality of sheets.

The present disclosure is not limited to specific embodiments described above, and numerous additional modifications and variations are possible in light of the teachings within the technical scope of the present disclosure. It is therefore to be understood that the disclosure of the present specification may be practiced otherwise by those skilled in the art than as specifically described herein. Such embodiments and variations thereof are included in the scope and gist of the embodiments of the present disclosure and are included in the embodiments described in claims and the equivalent scope thereof.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above. Each of the functions of the described embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

This patent application is based on and claims priority to Japanese Patent Application No. 2020-141859, filed on Aug. 25, 2020, in the Japan Patent Office, the entire disclosure of which is hereby incorporated by reference herein.

REFERENCE SIGNS LIST

1 Image forming apparatus
10 Image forming device controller
11 Central processing unit (CPU)
12 Read only memory (ROM)
13 Random access memory (RAM)
14 Serial interface (I/F)
20 Image forming unit
21 Entrance
22 Outlet
23 Bifurcating claw
24 Output tray
30 Image reading unit
40 Operation display unit
50 Post-processing controller
51 Central processing unit (CPU)
52 Read only memory (ROM)
53 Random access memory (RAM)
54 Serial interface (I/F)
60 Components
61 Driver
70 Sensor
100 Image forming device
200 Sheet folding device
F1 First folder
F2 Second folder
J1 First switching guide
J2 Second switching guide
J3 Third switching guide
P Sheet
P1 Preceding sheet
P2 Following sheet
P3 Next sheet
PL Final sheet
Q Sheet bundle
R0 Zeroth conveyer
R1 First conveyer
R2 Second conveyer
R3 Third conveyer
R4 Fourth conveyer
R5 Fifth conveyer
R6 sixth conveyer
SN1 First sheet detecting sensor
SN2 Second sheet detecting sensor
SN3 Third sheet detecting sensor
SN4 Fourth sheet detecting sensor
SN5 Fifth sheet detecting sensor
SN6 Sixth sheet detecting sensor
SN7 Seventh sheet detecting sensor
W1 First conveyance path
W2 Second conveyance path
W3 Third conveyance path
W4 Fourth conveyance path
W5 Fifth conveyance path
W6 Sixth conveyance path
W7 Seventh conveyance path

The invention claimed is:

1. A post-processing device comprising:

a circulation conveyance path including:

a first conveyance path;

a second conveyance path;

a third conveyance path;

a first conveyer configured to convey a preceding sheet from the first conveyance path;

a second conveyer configured to convey the preceding sheet along the second conveyance path; and a third conveyer configured to convey the preceding sheet from the third conveyance path to the first conveyance path;

the circulation conveyance path is configured to circulate the preceding sheet through the first conveyance path, the second conveyance path, and the third conveyance path using the first conveyer, the second conveyer, and the third conveyer, respectively;

a sheet-feeding conveyer configured to convey a following sheet toward the first conveyer in the first conveyance path; and a controller configured to control operations of the sheet-feeding conveyer, the first conveyer, the second conveyer, and the third conveyer, the controlling the operations including, controlling the third conveyer to stop the preceding sheet, and controlling the sheet-feeding conveyer and the third conveyer to, overlay the preceding sheet with the following sheet to form a sheet bundle having a desired shift amount between a leading edge of the preceding sheet and a leading edge of the following sheet, and strike the leading edge of the preceding sheet and the leading edge of the following sheet against the first conveyer.

2. The post-processing device according to claim 1, wherein the controller is further configured to, control the first conveyer to stop an operation of the first conveyer in response to the leading edge of the preceding sheet and the leading edge of the following sheet striking against the first conveyer.

3. The post-processing device according to claim 1, wherein the controller is further configured to:

control the sheet-feeding conveyer and the third conveyer to repeat operations that overlay the preceding sheet with the following sheet to form the sheet bundle having the desired shift amount between the leading edge of the preceding sheet and the leading edge of the following sheet and form a sheet bundle including a plurality of sheets, and perform a final overlay operation on the sheet bundle, the final overlay operation including using a second desired shift amount between a leading edge of a final sheet that is finally overlaid on the sheet bundle and the leading edge of the following sheet, the second desired shift amount being smaller than the desired shift amount between the leading edge of the preceding sheet and the leading edge of the following sheet.

4. The post-processing device according to claim 1, wherein the controller is further configured to:

change the desired shift amount based on a type of the preceding sheet.

5. The post-processing device according to claim 1, wherein the controller is further configured to:

change, based on the desired shift amount, an abutment amount of the sheet bundle including the preceding sheet overlaid in the first conveyance path with respect to the first conveyer.

6. The post-processing device according to claim 1, wherein the controller is further configured to:

change the desired shift amount based on a state of a printed surface of the preceding sheet.

7. The post-processing device according to claim 1, wherein the controller is further configured to:

change the desired shift amount based on a relation between a desired folding position associated with the sheet bundle and an image-formed position of an image formed on a sheet of the sheet bundle.

8. The post-processing device according to claim 1, wherein the controller is further configured to:

change the desired shift amount based on a desired folding type associated with the sheet bundle to be folded.

9. An image forming apparatus comprising:

an image forming device configured to form an image on a sheet; and the post-processing device according to claim 1.

10. An image forming system comprising:

an image forming apparatus configured to form an image on a sheet, and the post-processing device according to claim 1.

* * * * *